US010934075B2

(12) United States Patent
Cedergren et al.

(10) Patent No.: US 10,934,075 B2
(45) Date of Patent: Mar. 2, 2021

(54) DISPENSING DEVICE

(71) Applicant: ASEPT INTERNATIONAL AB, Lund (SE)

(72) Inventors: Stefan Cedergren, Bunkeflostrand (SE); Daniel Cedergren, Lund (SE)

(73) Assignee: ASEPT INTERNATIONAL AB, Lund (SE)

( * ) Notice: Subject to any disclaimer, the term of this patent is extended or adjusted under 35 U.S.C. 154(b) by 0 days.

(21) Appl. No.: 16/490,434

(22) PCT Filed: Mar. 2, 2018

(86) PCT No.: PCT/SE2018/050204
§ 371 (c)(1),
(2) Date: Aug. 30, 2019

(87) PCT Pub. No.: WO2018/160131
PCT Pub. Date: Sep. 7, 2018

(65) Prior Publication Data

US 2020/0047978 A1 Feb. 13, 2020

(30) Foreign Application Priority Data

Mar. 3, 2017 (SE) ..... 1750239-4

(51) Int. Cl.
*B65D 83/00* (2006.01)
*A47G 19/18* (2006.01)

(52) U.S. Cl.
CPC ..... *B65D 83/0027* (2013.01); *A47G 19/18* (2013.01); *B65D 83/0072* (2013.01)

(58) Field of Classification Search
CPC ..... A45D 40/04; A45D 40/06; A45D 40/12; B65D 83/0027; B65D 83/0072; A47G 19/18
(Continued)

(56) References Cited

U.S. PATENT DOCUMENTS 3,815,787 A * 6/1974 Spies ..... A47J 9/00 222/95
4,020,975 A 5/1977 Stauffer
(Continued)

FOREIGN PATENT DOCUMENTS

WO WO 98/42243 A1 10/1998
WO WO 2011/122305 A2 10/2011

OTHER PUBLICATIONS

International Search Report for International App. No. PCT/SE2018/050204, dated May 22, 2018, in 14 pages.

*Primary Examiner* — Paul R Durand
*Assistant Examiner* — Andrew P Bainbridge
(74) *Attorney, Agent, or Firm* — Knobbe Martens Olson & Bear, LLP

(57) ABSTRACT

The present invention relates to a feeding device (1) for manual dispensing of a food product in fluid form packaged in a flexible container (3) and a method for this, which invention solves the problem of bulky and heavy feeding devices which leak food product. The feeding device comprises a dispensing tank (10) adapted to hold the container, an operating sleeve (30) arranged on top of the dispensing tank, and a piston (40) arranged inside the dispensing tank and adapted to compress the container when the operating sleeve by rotation axially displaces the piston along the inside of the dispensing tank in a discharging direction so that the container is compressed while dispensing the food product (2) and allows a return of the piston in a return direction opposite the discharging direction after each dispensing of food product.

24 Claims, 12 Drawing Sheets

(58) Field of Classification Search
USPC ..... 401/175; 222/93, 386, 390; 221/222, 221/226–227, 231, 245, 279
See application file for complete search history.

(56) References Cited

U.S. PATENT DOCUMENTS

| | | | | |
|---|---|---|---|---|
| 6,592,278 | B1 * | 7/2003 | Holthaus | A45D 40/04 401/66 |
| 7,946,780 | B2 * | 5/2011 | Zhang | A45D 34/042 401/175 |
| 8,978,934 | B2 * | 3/2015 | Levesley | A45D 34/04 222/336 |
| 2015/0030372 | A1 * | 1/2015 | Tani | B43K 24/06 401/75 |
| 2015/0174332 | A1 * | 6/2015 | Raab | A61M 5/24 222/390 |
| 2020/0047978 | A1 * | 2/2020 | Cedergren | B65D 83/0072 |
| 2020/0148462 | A1 * | 5/2020 | Brugger | B65D 83/64 |

* cited by examiner

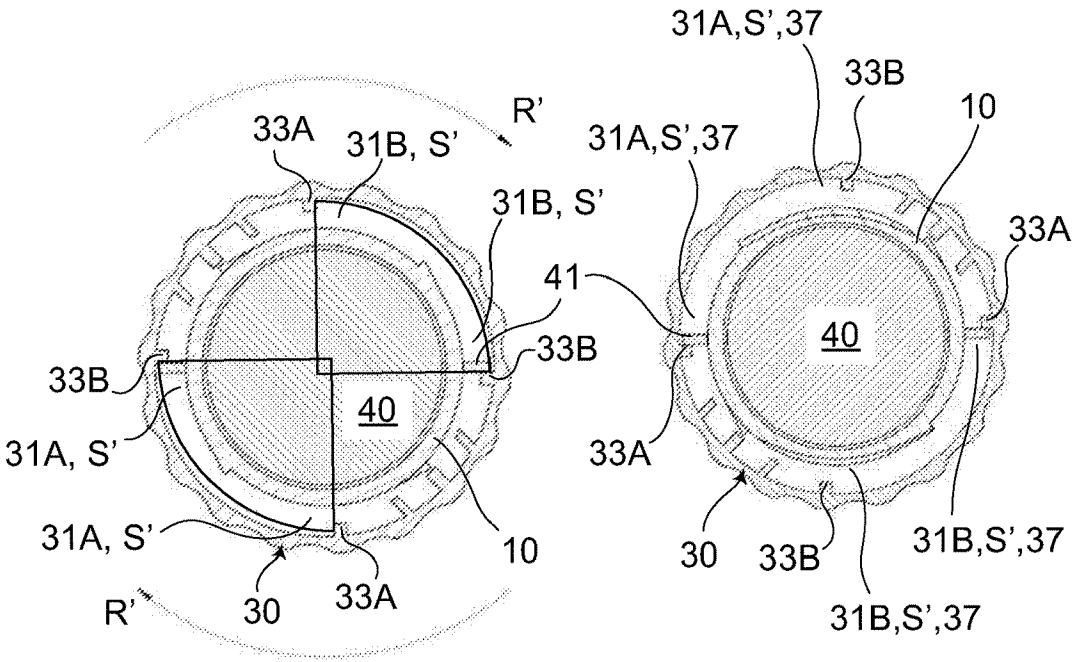
Fig 14B
Fig 14C
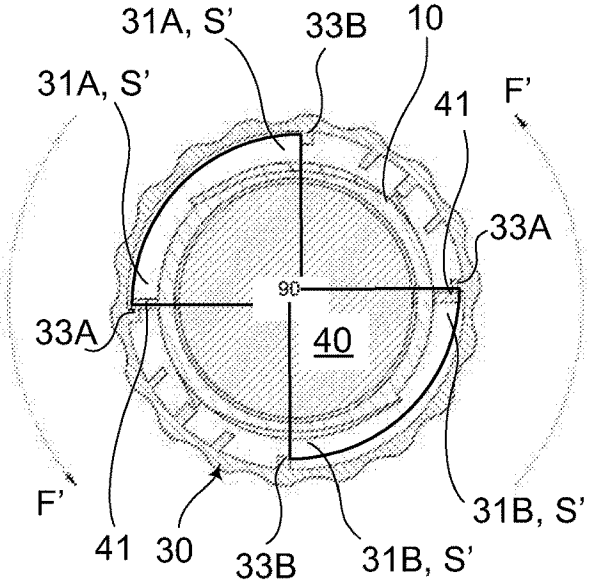
Fig 14A

DISPENSING DEVICE

TECHNICAL FIELD

The present invention relates to a feeding/discharging device for dispensing of liquid food or food in fluid form from a food container which is designed to collapse when the food is forced out from it. The feeding device is adapted to be hand-operated, i.e. manual dispensing of liquid foods.

BACKGROUND

Within the food industry there are many examples of devices for dispensing of foods. One known device for manual dispensing of foods employs a cartridge-type food container of tubular shape with rigid shell and ends, where one end is provided with a movable end cap bottom for a piston function and the opposite end has a fixed end cap with an outlet. The container is placed in a cylinder structure in the feeding device. The cartridge container can be manufactured from a mixture of layers of various material, such as paper and plastic/metal film. The pistol-shaped feeding device comprises a central piston rod which is moved against the movable end cap of the cartridge container after inserting the latter in a starting position. The container bottom is displaced when the handle of the piston is pushed in by hand so that the piston rod moves axially against and pushes against the movable container bottom to press out the contents through the outlet in the opposite end of the container. When the piston rod has pressed the movable bottom of the container to an end position where the major portion of the piston rod has been inserted into the container, most of the contents have been emptied. The piston rod is then released and pushed back the entire distance from the empty cartridge container's length past its starting position so that the empty container can be removed and replaced with a new full one. The movable container end cap is sealed against its cylindrical interior on the inside and during its displacement along the interior of the container.

One example of a pistol-type feeding device is described in WO 2005/097354 A1. Another known dispensing device is described in U.S. Pat. No. 3,815,787 A.

The drawbacks of such a known feeding device are its structural length, its weight, its specially designed rigid container with poor shelf life of the food therein, and unwanted and uncontrollable leakage of the food.

SUMMARY OF THE INVENTION

One purpose of the invention is to provide a dispensing/feeding device for dispensing of food products in fluid form packed in a flexible container and a method for dispensing of food products which solves at least some of the above mentioned problems.

Another purpose of the invention is to design a simple operation and handling of the feeding device by making it more compact and easy to handle, as well as readily accessible, and to create a more ergonomically oriented way of working and an ergonomically correct working posture when using it, having a smaller deflection during use.

Another purpose of the invention is to create a more simple installation requiring less space, since the feeding device is more compact, i.e., less bulky than known ones.

Another purpose of the invention is to provide a less demanding installation and handling of the feeding device when being carried about and handled by the operator as it has at least relatively low weight as compared to known devices.

Yet another purpose of the invention is to provide a more hygienic handling and dispensing of foods in that its less bulky design makes it easier to clean and also makes the cleaning faster.

Another purpose of the invention is to provide a more correct dispensing of the quantity of food product being discharged, since a predetermined and exact rotation allows a corresponding axial dispensing of the food with a greater predetermined accuracy as compared to the prior art which uses only linear/axial movements for the dispensing.

Another purpose of the invention is to create an easier reloading of the feeding device when its container is emptied of food product and a new full one with food product is to be inserted, since its compactness does not require such large movements as in the prior art and involves less effort by an operator.

These purposes are further achieved with the aid of a feeding device for dispensing of food products in fluid form, packaged in a flexible container, according to the related independent claim, with preferred variants as defined in the related dependent claims.

These purposes are further achieved with the aid of a method for dispensing of food products in fluid form, packaged in a flexible container, according to the independent method claim.

The feeding device for manual dispensing of a food product in fluid form packaged in a flexible container comprises a dispensing tank adapted to hold the container, an operating sleeve arranged on top of the dispensing tank, and a piston arranged inside the dispensing tank and adapted to compress the container, which internal piston contains at least one outer engagement means adapted to run through at least one slot in the dispensing tank for movable engagement with the inside of the operating sleeve, which operating sleeve comprises on its inside an engaging portion for cooperating with the piston's outer engagement means, so that the operating sleeve is adapted to axially displace the piston by rotation along the inside of the dispensing tank in a dispensing direction so that the container is compressed while dispensing the food product and adapted to allow and/or alternatively to force a return of the piston in a return direction opposite the discharging direction after each dispensing of food product, which feeding device comprises at least one blocking device adapted to allow axial movement of the piston in only the dispensing direction when the operating sleeve moves the piston in the dispensing direction by releasable interacting engagement with the dispensing tank via at least one external spiral track on the dispensing tank, which outer track is adapted to engage with at least one inwardly facing track slider on the blocking device, which engagement after being coupled is adapted so that rotation of the blocking device only allows a rotation thereof in the outer track when the blocking device is in engagement with the outer track and in the blocking position, while a decoupling of the engagement allows axial displacement of the blocking device in relation to the dispensing tank when the blocking device is released with its track slider from its blocking position, and the operating sleeve at a first end comprises one or more inner feeding abutments adapted for releasable engagement with one or more outer feeding means of the blocking device. One advantage with the above feeding device and its functionality provided by an angular rotation of the operating sleeve which is translated into an axial displacement of the piston in the dispensing direction is that correct, accurate and repeatable dispensing of the quantity of food product being discharged is accomplished at the same time as the return position for the piston which is allowed by a back rotation in the opposite return direction of the operating sleeve without the blocking device being moved or rotated produces a controllable and robust/secure eliminating of after-drip of food product.

In another embodiment, the feeding device comprises at least one ring-shaped/annular blocking device arranged in a ring-shaped/annular space or gap between the inner dispensing tank and the outer operating sleeve. In yet another embodiment, the feeding device comprises at least one blocking device which has a passive state when it is released from the blocking position (and released from physical engagement with the dispensing tank) and an active state when it is located in the blocking position which allows axial movement of the piston in the dispensing direction when the operating sleeve is rotated in a first rotation direction and allows axial piston movement opposite the dispensing direction when the operating sleeve is turned in a rotation direction opposite its first rotation direction. In yet another embodiment, the dispensing tank comprises at least one or more continuous slots running axially along its lateral surface, through which slot the piston's outer engagement means extends. In still another embodiment, the piston comprises at least one or more externally placed engagement means. In yet another embodiment, the feeding device comprises at least one blocking device arranged in a ring-shaped/annular space between the dispensing tank and the operating sleeve and it is in movable engagement with the operating sleeve and the dispensing tank such that the blocking device itself is limited to moving in only one rotation direction translatable into axial movement in the dispensing direction of the piston when the blocking device is in the active state or blocking position. In yet another embodiment, the blocking device and the operating sleeve are adapted to each other so that a defined rotation of the operating sleeve in a first direction means that it rotates together with the blocking device in its blocking position such that a defined axial displacement is imposed on the piston so that it displaces a predetermined volume per step inside the dispensing tank in the dispensing direction and a following defined rotation of the operating sleeve opposite the first direction means that the operating sleeve only allows and/or alternatively constrains a defined return stroke of the piston in a direction opposite the dispensing direction for each dispensing of food product. In still another embodiment, the dispensing tank, the blocking device and the operating sleeve are so adapted to each other that the return stroke of the piston occurs with an equal, larger, or smaller volume displacement as compared to that in the dispensing direction. In yet another embodiment, the dispensing tank comprises at least one external spiral track with a definite gradient/pitch for the movable and releasable interacting engagement with at least the inwardly directly track slider on the blocking device. In accordance with any one of the above embodiments, at least one advantage is achieved by a defined angular rotation which is translated into a defined axial displacement of the piston in the dispensing direction which provides a predetermined correct, accurate and repeatable dispensing of the quantity of food product being discharged at the same time as the operating sleeve and the blocking device control the predetermined allowed or constrained piston return stroke providing a guaranteed exactly repeatable elimination of after-drip of food product. One advantage which is achieved by means of any one or more of the above embodiments is that the blocking device is multifunctional and enables a simple, fast, and effective reloading of the feeding device when an empty container is to be replaced by a new and full one for continued dispensing of food product, since the manipulation and movements required for the replacement are less strenuous to the operator.

In a certain embodiment, the operating sleeve's inner interacting engaging portion allows a rotation of both the operating sleeve and its interacting engaging portion in relation to the piston's engagement means during simultaneous axial displacement of the piston in both the return and the dispensing direction. In one embodiment, the blocking device and the operating sleeve are adapted to each other so that rotation of the operating sleeve moves the blocking device in only the one of the rotation directions of the operating sleeve for axial displacement of the piston in the dispensing direction when the blocking device is in its blocking position. In another embodiment, the blocking device and the operating sleeve are adapted to each other so that rotation of the operating sleeve in one direction moves the blocking device in the same direction and moves the piston in the dispensing direction for dispensing of food product, while rotation of the operating sleeve in the other direction does not entrain the blocking device which blocks its rotation in this other direction at the same time as the operating sleeve allows or alternatively constrains a return of the piston in the return direction after dispensing of food product. In yet another embodiment, the operating sleeve's inner interacting engaging portion is a flange at least partly encircling inside the operating sleeve and directed inwardly, having a gradient in the dispensing direction. In another embodiment, the operating sleeve comprises at a first end two, three, four or five inner feeding abutments adapted for releasable engagement with one, two, three or four outer feeding means of the blocking device. In another embodiment, the operating sleeve at a second end comprises one or more inner stops adapted for movable engagement with the piston's outer engagement means so that the rotational movement of the operating sleeve itself is limited in each of its rotation directions when the inner stop on the operating sleeve comes into contact with corresponding outer engagement means on the piston. In an additional embodiment, the operating sleeve's inner interacting engaging portion comprises a planar surface configured as a sloping plane with gradient arranged so that when the operating sleeve is rotated in one direction the piston is displaced in the dispensing direction and when the operating sleeve is rotated in the opposite direction the return stroke of the piston is allowed and/or alternatively constrained.

In one embodiment, the operating sleeve's inner stop is arranged at its other end for engagement with the piston's outer engagement means and it has a placement which is adapted to the placement of the operating sleeve's inner feeding abutment at its first end, which feeding abutment is adapted for releasable engagement with the blocking device's outer feeding means at a first end portion, so that rotation of the operating sleeve in a direction from a first stop position to a second stop position moves the blocking device from a position of rest to a maximum position and brings about an axial displacement of the piston in the dispensing direction for compression of the container adapted to the quantity of food product being dispensed, and subsequent rotation of the operating sleeve in the opposite direction from its second stop position in the maximum position back to its first stop position in the position of rest is allowed by releasing of the operating sleeve's engagement in the blocking device, which allows and/or alternatively constrains an axial displacement of the piston in its return direction. In another embodiment, the gradient of the operating sleeve's inner engaging portions and the gradient/pitch of the external track on the dispensing tank are adapted to each other so that rotation of the operating sleeve from its first stop position at the beginning of the gradient to its second stop position at the end of the gradient is adapted to discharge a defined quantity of food product by means of a predetermined axial displacement of the piston in the dispensing direction, and subsequent rotation of the operating sleeve in the opposite direction from its second stop position back to its first stop position allows and/or alternatively constrains the axial piston displacement in the return direction. In still another embodiment, the dispensing tank comprises external blocking means adapted to movable engagement with internal blocking means at one or more blocking devices, which engagement allows rotation of each blocking device in only one direction translatable into the piston's axial dispensing direction by blocking the rotation of each blocking device in the opposite direction corresponding to the piston's axial return direction. In another embodiment, the feeding device comprises one or more blocking devices comprising external blocking means adapted for releasable engagement with internal feeding abutments in the operating sleeve, which engagement allows a defined rotation of the operating sleeve in one direction to entrain the blocking device in the same direction so that the piston is displaced axially in the dispensing direction for a predetermined distance adapted to the quantity of food product which is to be discharged, and a defined rotation of the operating sleeve in the opposite direction releases it from the entraining engagement with the blocking device, so that only the operating sleeve is rotated back while each blocking device remains in its position, and allows and/or alternatively constrains an axial displacement of the piston in the return direction for a predetermined distance relative to the piston displacement in the dispensing direction. In yet another embodiment, the operating sleeve comprises at least one movable portion which is adapted to produce an automatic return movement of the operating sleeve in the return rotation direction after the piston has been axially displaced along the dispensing tank for a predetermined distance in the dispensing direction and a defined quantity of food product has been discharged, whereby the piston is allowed and/or alternatively constrained to perform a corresponding return movement opposite its axial displacement in the dispensing direction. In one embodiment, the feeding device comprises a release and return mechanism adapted as a release sleeve adapted to manual coupling of the track slider engagement of at least one blocking device with the outer track of the dispensing tank for activating of the blocking position of the blocking device and manual releasing of the engagement with the outer track of the dispensing tank for deactivating of the blocking position of the blocking device by axial displacement along a second end section on the blocking device, by which the track slider of the blocking device is releasable from engagement with the outer track of the dispensing tank when the release sleeve is pushed off from the track slider and can be brought into engagement with the outer track of the dispensing tank when the release sleeve is pushed across the track slider. This embodiment has the advantage that the blocking device, the operating sleeve and the piston can be returned axially and in linear manner in a simple way back to their starting position at the first end of the dispensing tank.

In one embodiment, the release sleeve comprises at least one axially running control means adapted for movable engagement with at least one outer aligning means running axially along the second end section of the blocking device. In another embodiment, the release sleeve is adapted to activate the blocking position of the blocking device in engagement with the dispensing tank by axial displacement onto and along the second end section of the blocking device in the direction toward a first end section on the blocking device into a first position corresponding to the blocking position of the blocking device when the track slider of the blocking device is in engagement with the outer track of the dispensing tank and designed to deactivate the engagement of the blocking device's track slider with the outer track of the dispensing tank by axial displacement along the blocking device in the opposite direction into a second position which releases the engagement of the blocking device's track slider and releases it from its blocking position on the dispensing tank. In yet another embodiment, the blocking device comprises movable outer parts on its second end section, which parts comprise the blocking device's track slider directed inward, and the release sleeve comprises inner axially extending control surfaces, which movable outer parts and inner control surfaces are adapted to each other such that the control surfaces inside the release sleeve press in the movable outer parts of the blocking device and the corresponding track slider when the release sleeve is shoved axially across the second end section of the blocking device in the direction toward its first end section, into a first position in engagement with the dispensing tank where the blocking position of the blocking device is activated, and upon displacement of the release sleeve along the blocking device in the opposite direction from its first end section the inner control surfaces move across and past the outer movable parts so that their track slider moves outward and thereby deactivates the blocking position of the blocking device by releasing its engagement with the dispensing tank.

In yet another embodiment, the inner axially extending control surfaces of the release sleeve are raised. In one embodiment, the dispensing tank comprises at least one external spiral track with a gradient varying at least partly along its extension for movable releasable interacting engagement with at least one inwardly directed track slider on the blocking device, which engagement between the outer track and inner track slider after the coupling together is designed such that rotation of the blocking device only allows rotation of same in the outer track when the blocking device is in the blocking position, while a releasing from the engagement allows axial displacement of the blocking device in relation to the dispensing tank when the blocking device is released from its blocking position. According to any one of the above embodiments, at least the advantage is achieved that a defined angular rotation of operating sleeve and blocking device in a first direction which is translated into a defined axial piston displacement in the dispensing direction provides a predetermined correct, accurate and repeatable dispensing of the quantity of food being dispensed, while at the same time the dispensing tank, operating sleeve and blocking device, via their releasable interacting engagement which optionally provides the active and passive state of the blocking device, by a defined angular rotation of the operating sleeve only (without the blocking device, which is stationary) in the opposite direction, control the predetermined allowed/constrained piston return stroke which provides a guaranteed exactly repeatable elimination of after-drip of food.

The method according to the invention for manual dispensing of a food product in fluid form packaged in a flexible container designed to be contained in a dispensing tank by means of an operating sleeve arranged on top of the dispensing tank and a piston arranged inside the dispensing tank, adapted to compress the container, which inner piston comprises at least one outer engagement means adapted to run through the dispensing tank for movable engagement with the inside of the operating sleeve which comprises on its inside an engaging portion cooperating with the piston's outer engagement means, involving rotation of the operating sleeve for axial displacement of the piston along the inside of the dispensing tank in a dispensing direction which compresses the container for dispensing of food product and rotation of the operating sleeve to allow and/or alternatively constrain a returning of the piston in a return direction opposite the dispensing direction after each dispensing of food product, is characterized in that dispensing and resetting of the feeding device after emptying of a container's contents is made possible by means of a backstop function created with a blocking device which is dual-action in a blocking position which allows relative rotation between the dispensing tank and itself in only one direction, translatable into the piston's axial dispensing direction, but allows relative rotation between the operating sleeve and itself in two directions of the operating sleeve corresponding to both axial dispensing and return directions of the piston.

DESCRIPTION OF FIGURES

The invention shall be described in more detail with reference to the enclosed figures, which show examples of presently preferred embodiments of the invention.

FIG. 14A to 14C show in various plan views the discharging device according to FIG. 1-4 as seen in its lengthwise direction and different functional positions for specific components during use.

DESCRIPTION OF EMBODIMENTS

Figure 1:
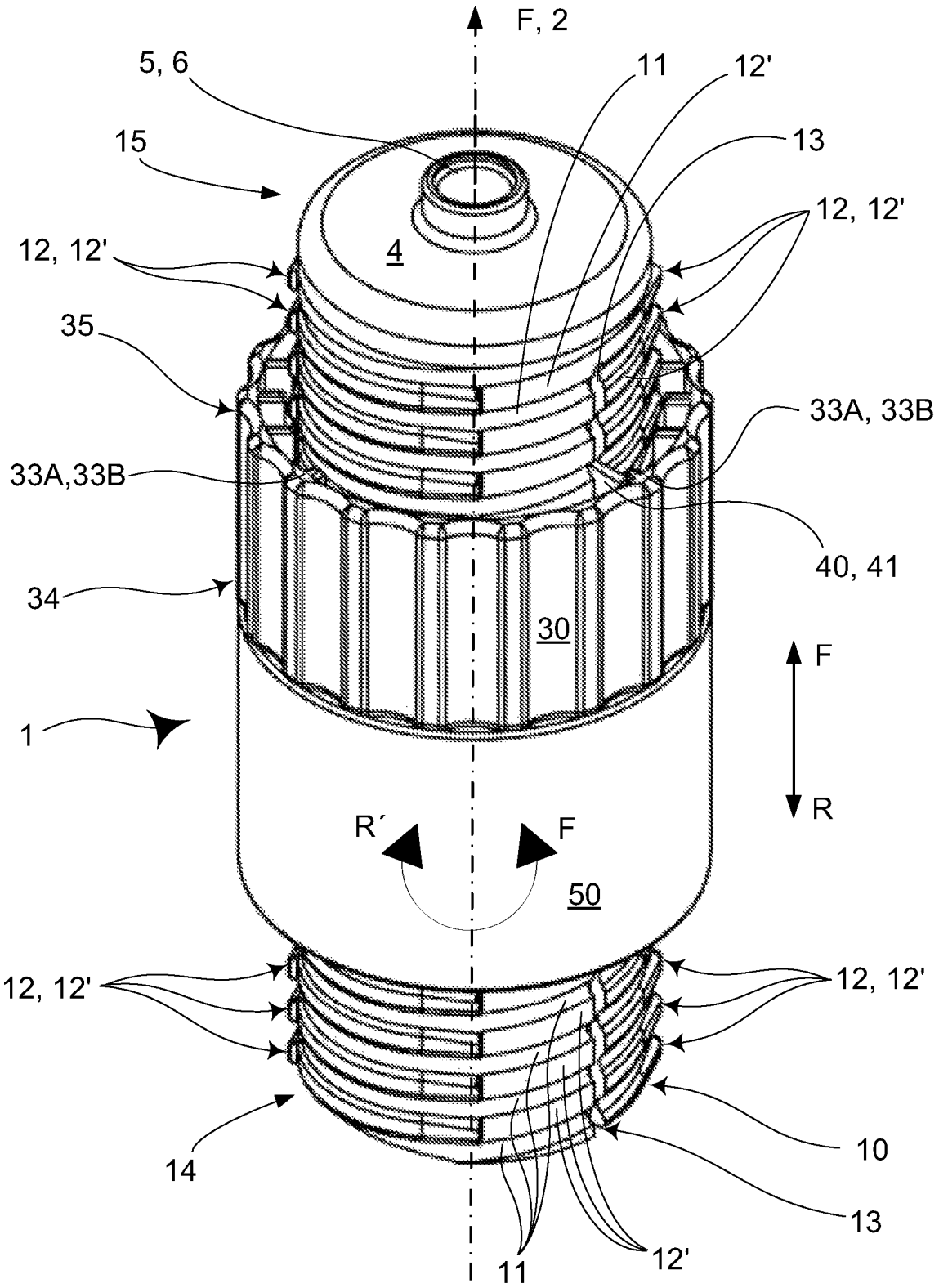
FIG. 1 shows the feeding device according to the invention in perspective.

A feeding/discharging device 1 according to the invention as shown in FIG. 1-15C is intended to dispense food products 2 from a flexible/compressible food receptacle/container 3. The food product or food 2 is preferably pasty, liquid, or in fluid form, without very large solid particles, preferably a negligible quantity of such. The food product 2 is of the air sensitive type, such as dressing, mayonnaise, mustard, ketchup, peanut butter or the like, but it may also be another type of sauce or dressing, or a drink. The container 3 consists of a material which can collapse when the food is dispensed by being pressed out from it and is preferably made of a plastic material with barrier properties which guarantee that the food may be kept air-tight and for a lengthy time at room temperature without risk of bacterial influence.

Figure 2:
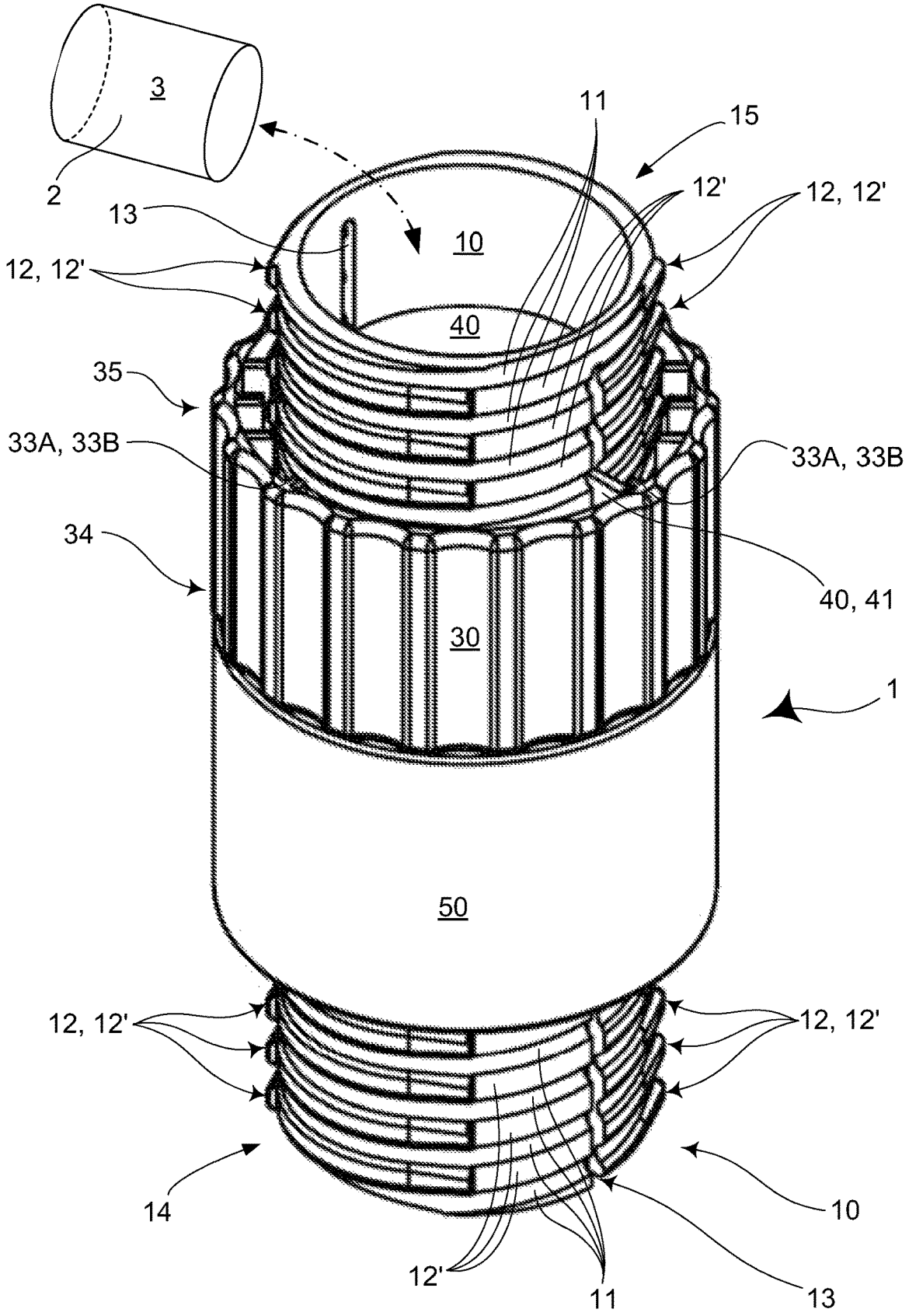
FIG. 2 shows the feeding device according to FIG. 1 during reloading.

In order to empty/dispense the food product 2 from the container 3 and dispense it from same (see arrow at reference symbols F, 2 in upper part of FIG. 1 and at right in FIG. 12A-D) by means of the feeding device 1, the container is inserted in an oblong dispensing tank 10 (see top part of FIG. 2), after which an end cap 4 is put back in place on top of the dispensing tank as in FIG. 1. In FIG. 2 the end cap 4 has been removed so that the container 3 may be placed in or taken out from the dispensing tank 10 at its other end 15. Manual effort is preferably used to operate the feeding device 1 comprising the dispensing tank 10 designed with an internal space and an operating sleeve 30 arranged on top of the dispensing tank. The operating can be done with electric motor, controlled as appropriate. The operating sleeve 30 is arranged at a first end 14 or starting end of the dispensing tank 10 in the starting position thereof, where the dispensing of the food product begins after the inserting of a full container 3 in the dispensing tank (see starting position/position of rest in FIG. 12A and a final/end/maximum position in FIG. 12D). At the other end 15 of the dispensing tank is an end cap 4 (see FIG. 1, 3), which is removable and contains an outlet 5 for dispensing the food product 2. The space in the dispensing tank 10 can hold flexible containers 3 of various size.

The feeding device 1 and its component parts are mostly made of plastic and not metal, said plastic being approved for food use.

Figure 3:
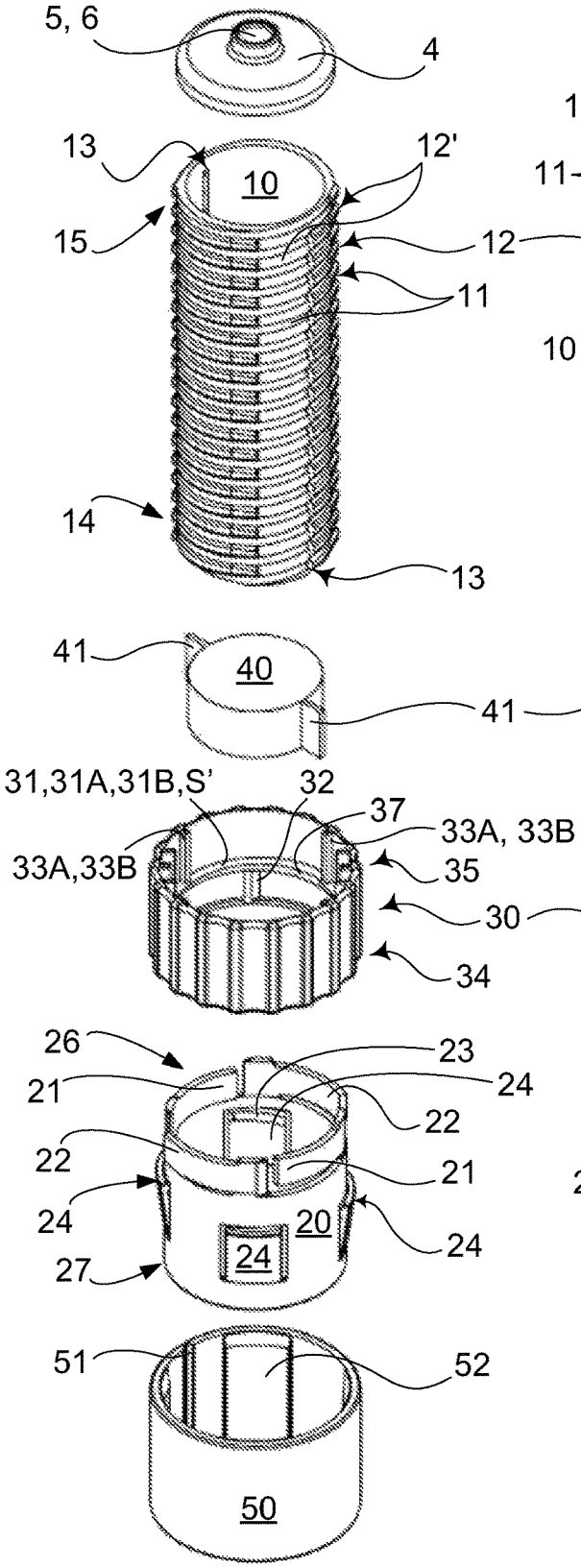
FIG. 3 shows by an exploded drawing in perspective the discharging device according to FIGS. 1 and 2 disassembled or during assembly.
Figure 4:
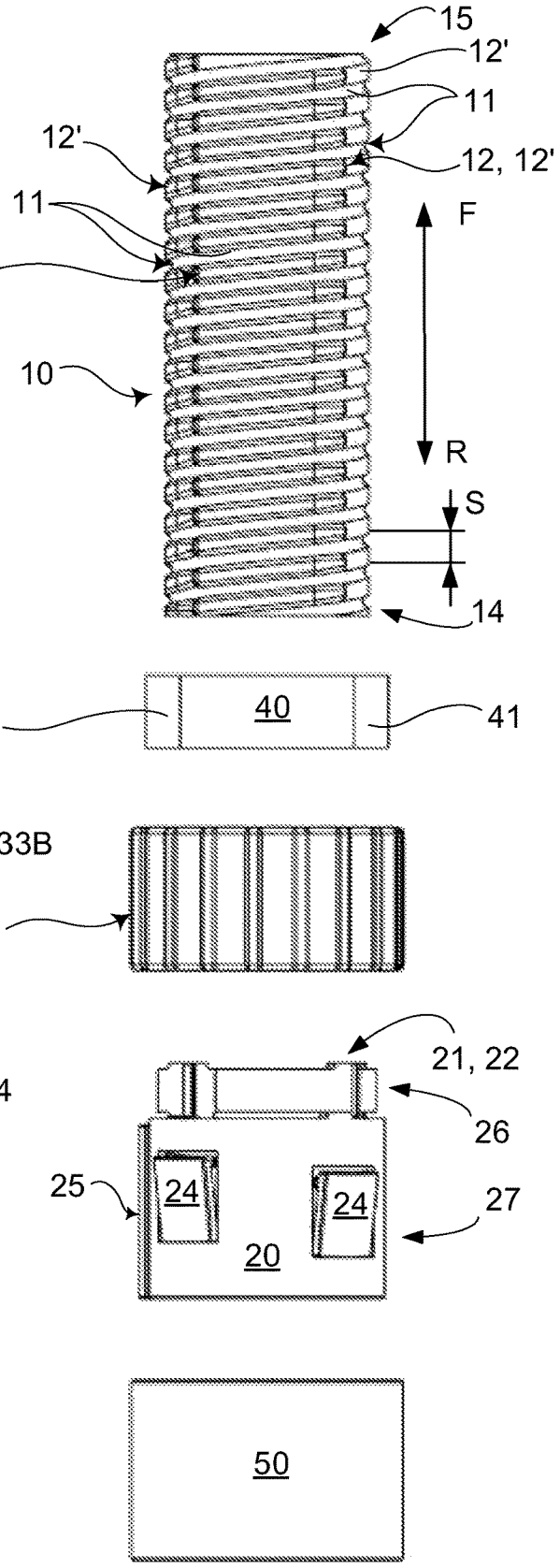
FIG. 4 shows in a side view the discharging device according to FIG. 3 disassembled or during assembly.
Figure 5:
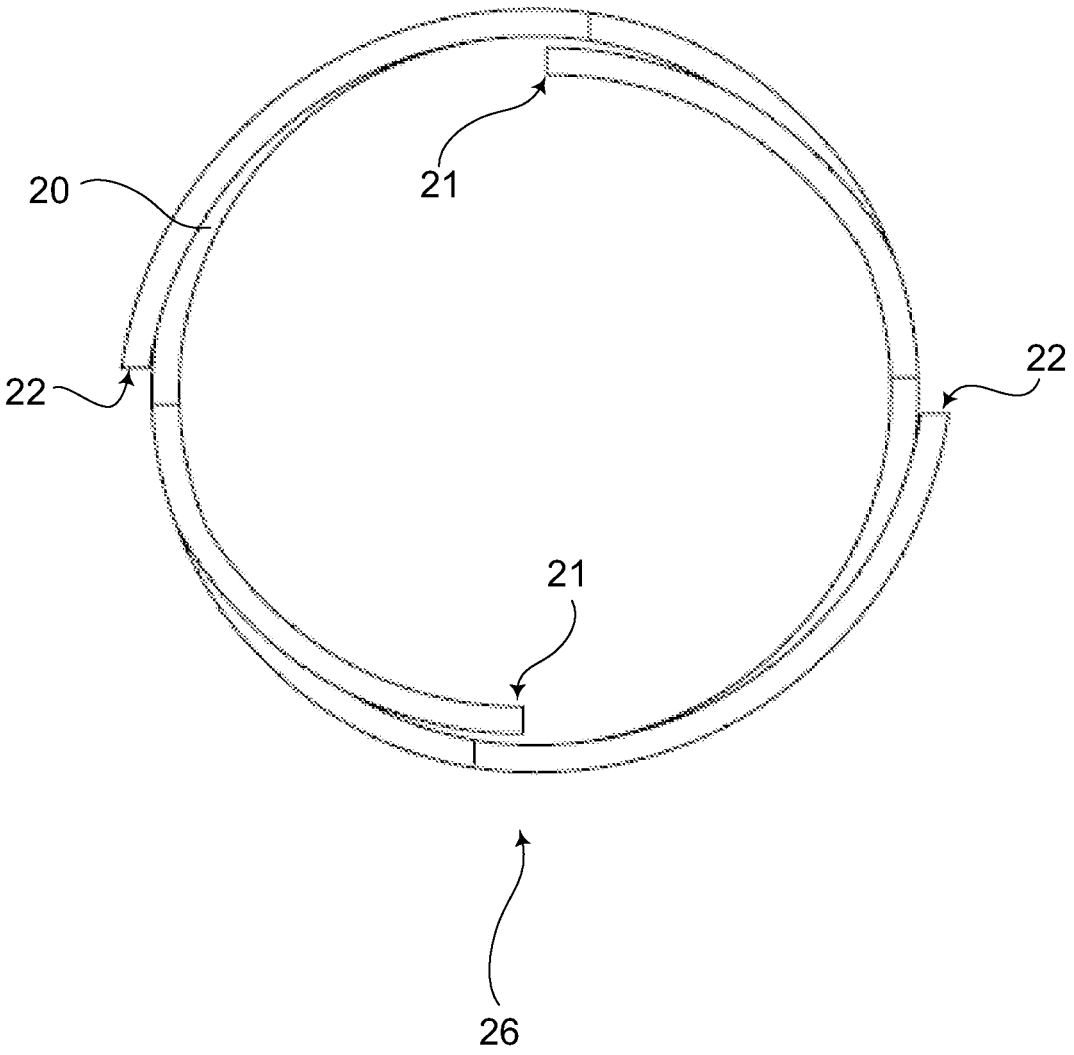
FIG. 5 shows a side view of a component which is part of the discharging device according to FIG. 1-4.
Figure 6:
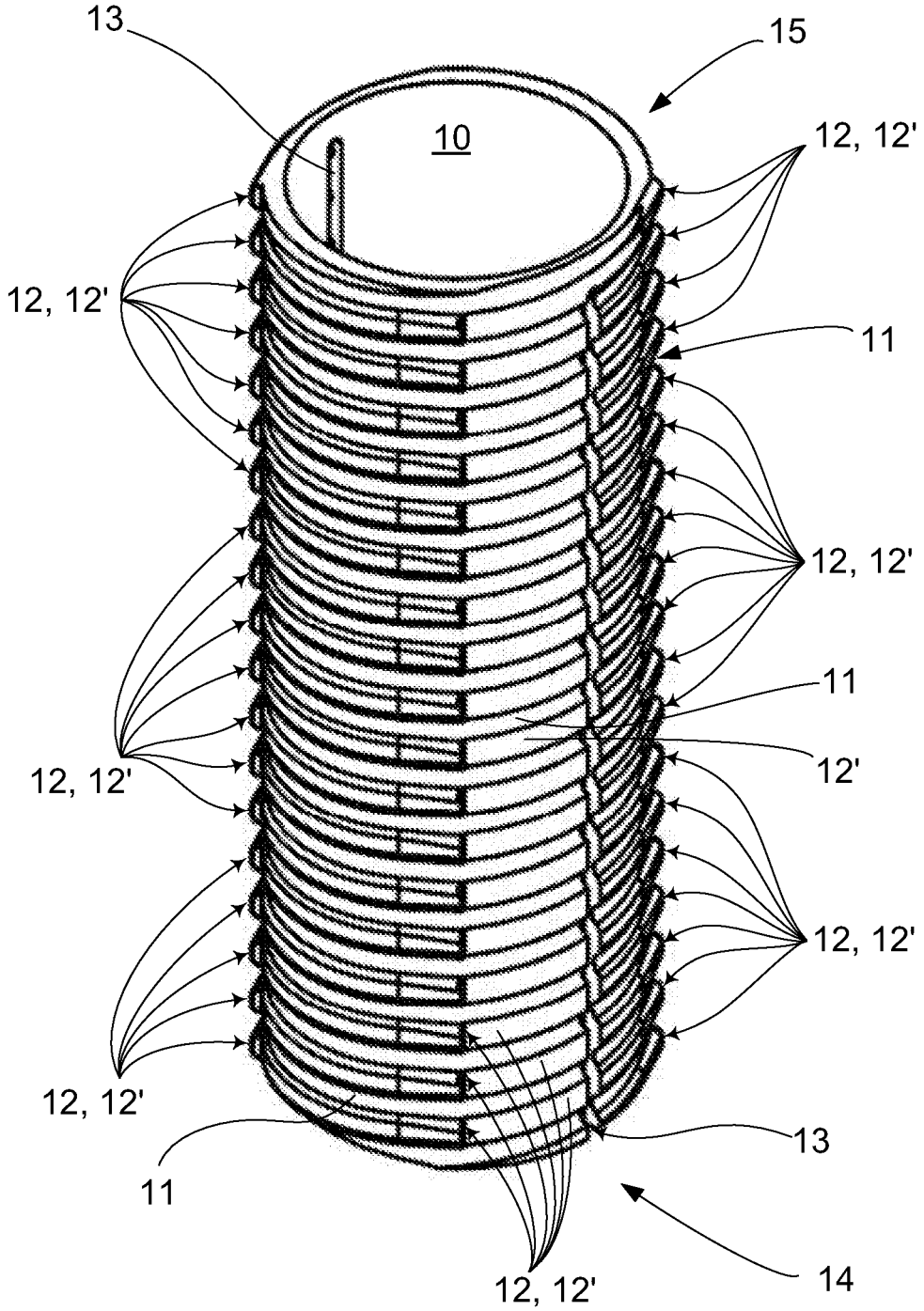
FIG. 6 shows a perspective view of a component which is part of the discharging device according to FIG. 1-4.
Figure 7:
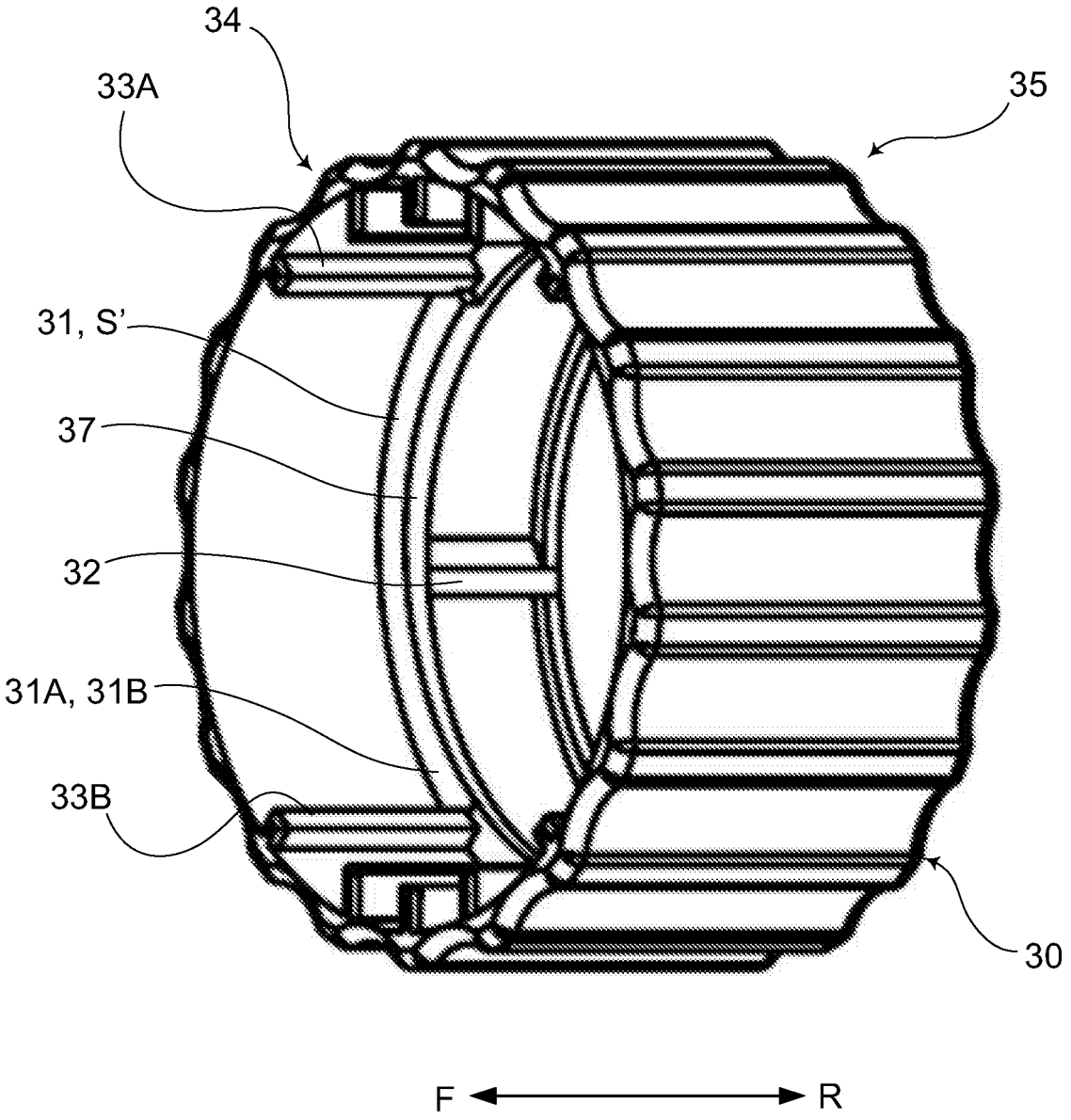
FIG. 7 shows in perspective yet another component which is part of the discharging device according to FIG. 1-4.
Figure 8:
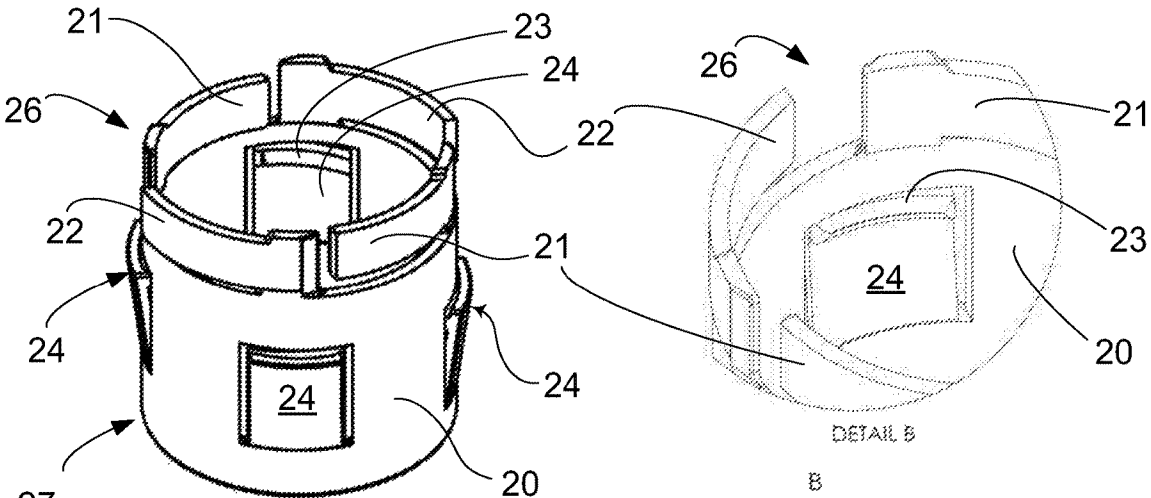
FIGS. 8 to 11 show in perspective views and partial enlargements two components which are part of the discharging device according to FIG. 1-4 in different phases of interaction.
Figure 12D:
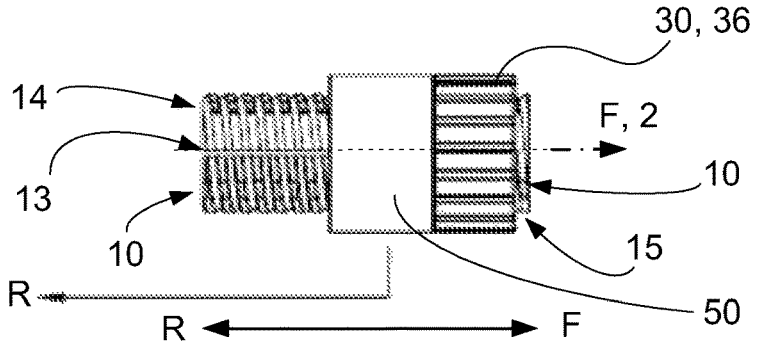
FIG. 12A to 12D show side views of the discharging device according to FIG. 2 in various functional positions during use.
Figure 12C:
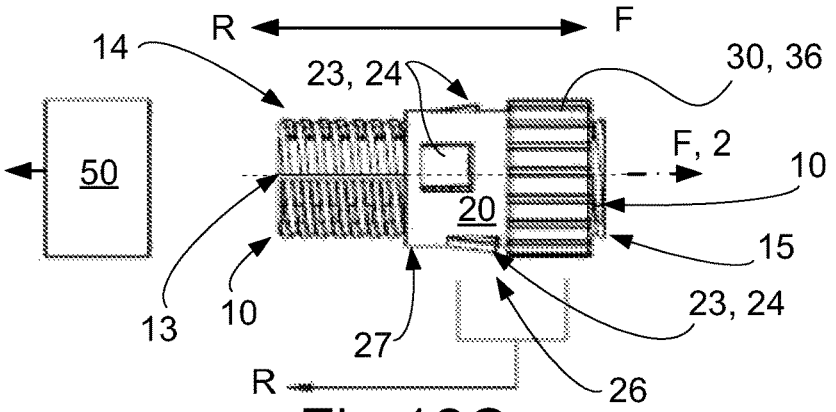
Figure 12B:
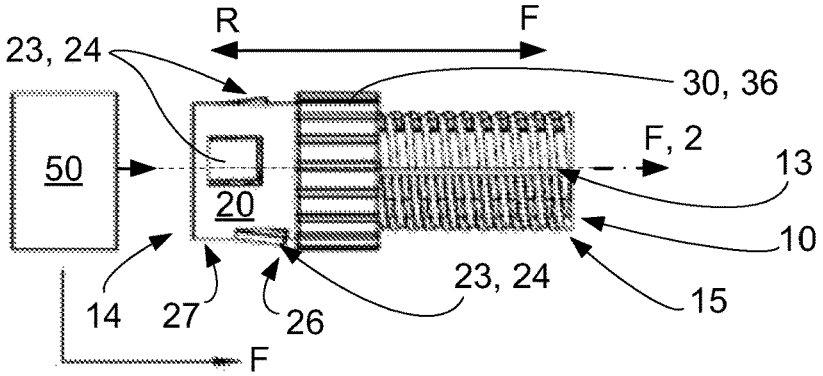
Figure 12A:
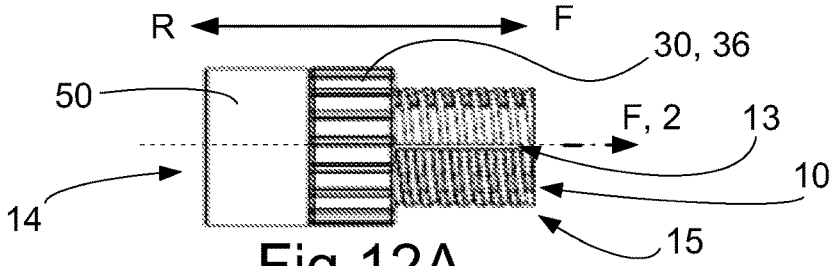

A movable piston 40 is adapted to be displaced axially inside and along the dispensing tank 10 by means of the operating sleeve 30 from its position of rest at the dispensing tank's first end 14 in FIG. 12A to the maximum position at the other end 15 in FIG. 12D. The piston lies and presses against the container 3 to compress the latter during the dispensing of food product 2 during its axial displacement along the dispensing tank. The piston 40 is seen partly at the top of FIG. 2 before having reached its maximum position as a movable bottom or wall in the dispensing tank 10 against which the container 3 will be or come in contact after being inserted in the dispensing tank via its opening in the other end 15 per FIG. 2. FIGS. 3 and 4 show the feeding device 1 disassembled. The inner piston 40 comprises outer engagement means/parts 41. The piston's outer engagement means 41 penetrate the dispensing tank 10 for movable engagement with the inside of the operating sleeve 30. Its outer engagement means 41 are formed as winglike projections (FIG. 3). The piston's engagement means 41 are formed as axially extending winglike projections (FIG. 3). The outer engagement means 41 are formed as diametrically opposite winglike projections (FIG. 3). The piston's outer engagement means 41 are formed as axially extending winglike projections which project radially in relation to the piston's center axis (FIG. 3). The piston is mounted removably in the dispensing tank 10. The piston 40 is led into and out from the dispensing tank via an opening in its first end 14 (FIG. 3, 4). The dispensing tank 10 comprises at least one, two or more continuous slots 13 along its length (FIG. 1, 2, 3, 6, 12A D, 13A-15C). Each slot 13 is open at the dispensing tank's first end 14. Each slot 13 extends radially through the entire shell thickness of the dispensing tank but not along the entire length of the dispensing tank, instead terminating at a distance from its other end, i.e., its discharging end 15. The dispensing tank 10 is therefore almost split all the way through its length. This means that the piston 40 can only be moved for a certain length from the first end 14 of the dispensing tank in its position of rest in FIG. 12A through the intermediate positions shown in FIGS. 1 and 2 inside the dispensing tank in the direction of the discharge end 15 to the maximum position in FIG. 12D where the container 3 is compressed to the maximum. The slot formation with closed ends also means that the piston 40 can only be taken out of the dispensing tank at its first end 14 where each slot is open and is prevented from accidentally dropping out from the discharge end 15 but depending on the fitting tolerances between slots 13 and piston's outer engaging portions 41.

The operating sleeve 30 is adapted to axially move the inner piston 40 along the inside of the dispensing tank 10 from its first end 14 (FIG. 12A) in a discharge direction F toward its other end 15 (FIG. 12D). This axial piston displacement dispenses food product 2 from the container 3 and via the outlet 5 in the end cap 4 across the other end 15 of the dispensing tank. The operating sleeve 30 is adapted to allow and/or constrain a return of the piston 40 in a return direction R opposite the dispensing direction F after dispensing of food product in order to relieve the pressure on the container after each completed dispensing so as to prevent after-drip of food product. The operating sleeve 30 and piston with outer engaging portions 41 are disposed to each other such that the piston is physically never entirely outside of the lengthwise extension of the operating sleeve. This means that the piston and its outer engagement means 41 are always located by at least one physical portion within/inside and in movable engagement with the operating sleeve's inside/inner shell surface. The piston 40 with outer engaging portions 41 is therefore always within the extension of the operating sleeve, looking radially along the length of the operating sleeve by at least one physical portion inside the operating sleeve 30.

FIGS. 3-4 show the component feeding parts of the feeding device 1 before being assembled or after disassembly. The end cap 4 with its outlet 5 may have a flat conformation with outlet centrally placed and/or directed with the longitudinal direction of the dispensing tank and/or central axis. The end cap 4 is preferably snapped on and off from the discharge end 15 of the dispensing tank. The end cap 4 is preferably made of silicone or some other similar food-approved plastic material, the same applies to all other feeding components of the feeding device 1. The end cap 4 may comprise more than one outlet 5.

The dispensing tank 10 in FIGS. 1-4, 6 and 12A-15C is tubular with a primarily cylindrical conformation or a completely cylindrical shape. Its lengthwise slots 13 extend parallel to its center axis and have a steering or orienting function for the piston 40 so that it can only move axially along the dispensing tank. The slots 13 make the dispensing tank resilient or flexible so that plastic molding or 3D-printing is facilitated for its manufacture, i.e., each slot makes possible the injection molding of the dispensing tank without it becoming "stuck" in the mold. The dispensing tank 10 comprises at least one external spiral track or thread 11. The dispensing tank 10 in one embodiment comprises external blocking means 12. The feeding device 1 comprises a blocking device 20 which comprises a first 26 and a second end portion 27 (see FIG. 3-5, 8, 10, 11, 12B-C, 13A-13D, 15A-15C). At least one blocking device 20 is disposed in one embodiment between dispensing tank 10 and operating sleeve 30, e.g., in a ring-shaped space or gap between these parts. The blocking device 20 is configured as a ring/sleeve and enables dispensing and resetting of the feeding device 1 after having emptied the contents of a container and it functions as a backstop, see below.

The above blocking device 20 has two functions. One function is to provide a manual coupling of the above discharging/feeding position and decoupling of the above discharging/feeding position in concert with a release sleeve 50 when the container 3 has been emptied and a new one can then be loaded into the dispensing tank 10. Another function is to provide a leak-free, accurate and repeatable manual dispensing of the correct amount of food product 2 during each discharging of same in concert with the operating sleeve 30. The blocking device 20 is dual-action in a blocking position which allows relative turning/rotation between dispensing tank 10 and itself in only one direction F' translatable into the piston's axial discharge direction F, yet allows relative turning/rotation between operating sleeve and itself in two directions F', R' for only the operating sleeve 30 corresponding to the piston's two axial discharge and return directions F, R.

The dispensing of the food product 2 by means of the feeding device 1 occurs in stages. Each dispensing involves the displacement of the piston 40 for a certain axial distance in the discharging direction F until a predetermined amount of food product is dispensed and the piston is then allowed or constrained to return in the return direction R during the same dispensing step. This return shifting or return motion R of the piston occurs with a certain distance which is equal to, longer than or shorter than its displacement or distance moved in the opposite discharging direction F.

The above distance in each direction F, R is selectable/controllable, i.e., it can be predetermined by dimensioning one or more external spiral tracks 11 or the gradient(s) S on one or more external threads 11 and their conformation and placement as well as the mutual layout of the dispensing tank's external blocking means 12 along each track or thread 11 and the dispensing tank's 10 outside as well as the blocking device's 20 conformation. The tracks 11 can be formed with different widths, depth and lengths. The track 11 may have a continuous or discontinuous extension. The track 11 may have a constant and/or variable pitch S along the outside/extension of the dispensing tank and/or a combination of constant and variable pitch S along its extension. The track 11 may have a smaller or lesser or finer or narrower pitch S along one portion of its extension and/or along its midsection and/or its entire extension. The track 11 may have a larger or coarser pitch S along part of or its entire extension. The track 11 may have a combination of smaller/finer/narrower pitch S along part of its extension, i.e., the outside of the dispensing tank, and a larger/coarser pitch S along another part of its extension, i.e., the outside of the dispensing tank. The track 11 may have a smaller/finer/narrower pitch S on one part of the dispensing tank 10, e.g., at one end 14, 15, or along the entire dispensing tank or along the entire extension of the track. The track 11 may have a larger/coarser pitch S on one part of the dispensing tank, e.g., at one end 14, 15, or along the entire dispensing tank or its entire extension. The track 11 may have a smaller/finer/narrower and/or a larger/coarser pitch S at the first end 14 and/or second end 15 and/or between these ends of the dispensing tank. The advantage of at least one or more constant and/or variable pitches S for one or more tracks 11 along at least one portion of and/or along the entire outside of the dispensing tank/extension of the track is that the dispensing can be performed and/or varied in a controllable manner. The discharging can therefore be optimized with a "slower" but "stronger" feeding by means of a finer pitch S, so that the container 3 is emptied by more food product 2, i.e., to a greater extent at the end, e.g., if the finer screw pitch is disposed at the discharge end 15 and/or a fast feeding may occur at the start of the dispensing, e.g., in order to force air more quickly out from a new container right after loading the feeding device 1 with a coarser screw pitch S arranged at the first end 14.

The feeding device 1 in another embodiment comprises the above release sleeve 50 which constitutes a release and return mechanism adapted for manual coupling of the blocking device's 20 engagement, i.e., slider, track, or thread engagement, with the outside of the dispensing tank 10 at its first end 14 for activation of the feeding position of the feeding device 1 and manual releasing of the slider engagement between blocking device 20 and dispensing tank 10 at its other end 15 for deactivation of the feeding position of the feeding device. The deactivation may also be done in intermediate position between the end positions of the dispensing tank. Activation and deactivation occurs by axial displacement of the release sleeve 50 along the other end portion 27 on the blocking device 20 in the direction R. The deactivation of the blocking position of the blocking device means that the blocking device is released from sliding engagement with the external track 11 on the dispensing tank 10 so that all movable feeding parts in the feeding device 1, i.e., the blocking device itself, the operating sleeve 30, the piston 40 and the release sleeve 50, when they have together reached their end position at the other end 15 of the dispensing tank (FIG. 12D) after final dispensing of food product 2 when the container 3 is compressed to the maximum and emptied of food product, are allowed to return to their starting position at the first end d14 of the dispensing tank (FIG. 12A). In the final position in FIG. 12D, the end cap 4 is removed (see FIG. 2) and the empty container 3 is taken out and the dispensing tank loaded with a new/full container and the end cap 4 is put back (see FIG. 1) before resuming the dispensing of food product 2. FIG. 12A-12D do not show how the container 3 is inserted or removed or how the end cap 4 is taken off or put on the dispensing tank in the end positions, this will be understandable by looking at FIG. 1 with end cap and FIG. 2 without end cap.

Figure 10:
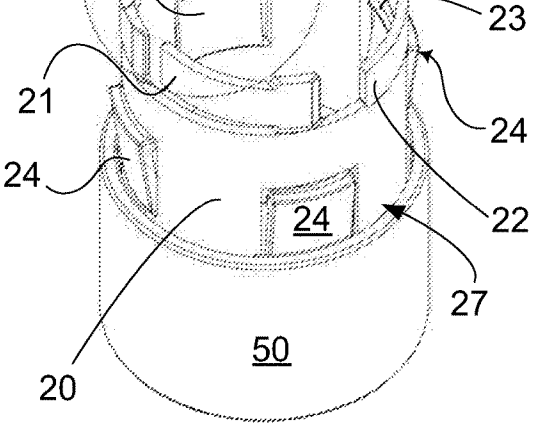
Figure 11:
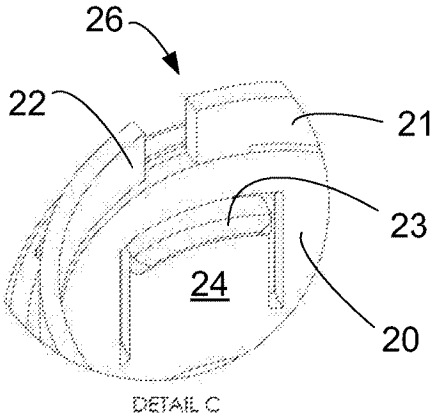
Figure 9:
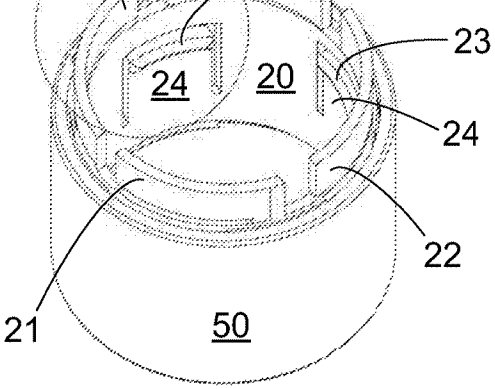
Figure 9:
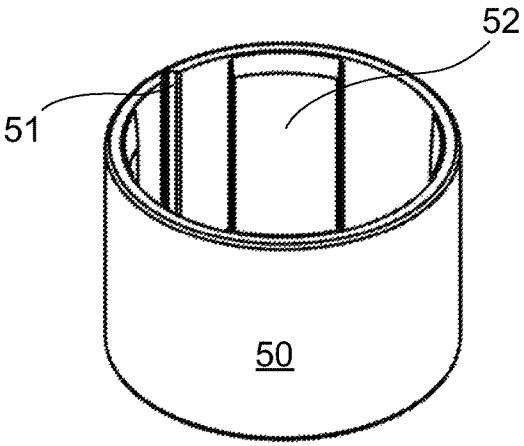

The above coupling and decoupling of the feeding position of the feeding device 1 is brought about in that the outer track/thread 11 on the dispensing tank 10 is adapted for movable coupling and decoupling sliding engagement with at least one, two or more inwardly directed and movable track/thread sliders or thread segments 23 on the inside of the blocking device 20 at its other end portion 27. The track 11 and track slider 23 are mutually adapted so that twisting of the blocking device 20 allows only rotation of same in the outer track 11 in relation to the dispensing tank 10 after coupling of its engagement (FIG. 12A) so that the blocking device is in its blocking position, while a decoupling of the engagement between the thread/track 11 and track slider 23 allows axial displacement of the blocking device along the dispensing tank without needing to twist the blocking device, which is then released from its blocking position, i.e., sliding engagement (FIG. 10, 12B, 12C). When the blocking device 20 is coupled in its active state/blocking position, dispensing of food product can occur via the feeding device 1, whereas discharging of same is prevented when the blocking device is released from its blocking position, i.e., when the feeding position of the feeding device is deactivated in order to return it and refill it with a new container 3 in place of an empty one prior to a new dispensing of food product 2.

The release sleeve 50 activates the blocking device's 20 sliding engagement/blocking position with the dispensing tank's 10 track 11 and the feeding device's feeding position when it is mounted on the blocking device by being axially shoved across and along the blocking device's other end portion 27 in the direction F according to the arrows in FIG. 12B toward the first end portion 26 on the blocking device into a first position corresponding to the blocking device's blocking position and position or rest in FIG. 12A. The release sleeve 50 is not adapted to be twisted in relation to the blocking device 20. In the maximum position or emptied position of the feeding device 1 in FIG. 12D, where the piston 40 has reached the end position against the closing edge the slot 13, the sliding engagement of the blocking device with the dispensing tank's track 11 is deactivated and the feeding position of the feeding device is deactivated by shoving/pressing the release sleeve 50 axially along the blocking device in the opposite direction R per FIG. 12D as compared to the release sleeve's coupling direction F in FIGS. 12A and 12B until it is moved from the blocking device in FIG. 12C to a second position which releases the sliding engagement of the blocking device with the outer track 11 and releases it from its blocking position on the dispensing tank. When the blocking device 20 is released from its blocking position, maintaining its engagement with the dispensing tank 10, all feeding parts in the feeding device, i.e. blocking device, operating sleeve 30 and piston 40, can simply be returned to the position of rest in FIG. 12A where the release sleeve 50 can again be shoved onto the blocking device to once more activate the feeding position of the feeding device=blocking position of the blocking device. FIGS. 3, 4, 8, 9, 12B and 12C show the release sleeve 50 separately or entirely released from the blocking device 20, but it does not need to be completely separable from this. The release sleeve may be a part which is movably assembled and connected to the blocking device. In one embodiment, the blocking device 20 comprises one, two, three, four or more movable and outwardly pointing blocking means which may be studs or ribs or thread segments or tabs 24 on its other end portion 27 (FIG. 3, 4, 8-11, 12B, 12C). The tabs 24 comprise the blocking device's track/thread sliders 23 which can be tabs or ribs or thread segments. The above tabs or ribs or thread segments 23, 24 may be oriented partially slanted and/or straight inward toward the inside of the blocking device. The above tabs or ribs or thread segments 23, 24 may be oriented slanted and/or straight inward toward the inside of the blocking device. A tab 24 comprises at least one corresponding track slider 23. Each track slider 23 is slanted inward toward the outside of the dispensing tank. Each track slider 23 is directed primarily radially inward toward the outside of the dispensing tank when the blocking device 20 is shoved onto the dispensing tank. The release sleeve 50 in one embodiment comprises inner axially extending control surfaces 52. The movable outer tabs 24 on the blocking device 20 and the control surfaces 52 on the inside of the release sleeve are mutually adapted to each other so that the inner control surfaces of the release sleeve press in the outwardly directed tabs 24 of the blocking device and their track slider 23 primarily radially into engagement with the outer track 11 of the dispensing tank when the release sleeve 50 shoved axially over the second end portion 27 of the blocking device in the direction of its first end portion 26 per FIGS. 12B and 10 into the first starting position in FIGS. 11 and 12A, where the blocking position of the blocking device is activated. the movable outer tabs 24 and the inner control surfaces 52 are adapted to each other such that, when the release sleeve is shoved along the blocking device in the opposite direction R from its first end portion 26 in the starting position in FIG. 11, 12A and the maximum position in FIG. 12D, the inner control surfaces 52 of the release sleeve move across and out of abutment with the movable tabs 24 of the blocking device, which at the same time move outward from the dispensing tank 10 during movement of its track slider 23 out of engagement with the outer track 11 until the track sliders on the tabs have moved entirely out of engagement with the outer track 11 and thus deactivate the blocking position of the blocking device. FIG. 10 shows an intermediate position before the release sleeve 50 have been shoved entirely onto the second end portion 27 of the blocking device or before it has been withdrawn entirely from the latter, i.e., when the tabs 24 have been pressed in or moved outward a bit, but not entirely into their end position. In one embodiment, the movable tabs 24 of the blocking device are elastic.

The release sleeve 50 comprises at least one, two or more control means 51 extending axially along its inside. Each control means 51 is adapted for movable engagement with at least one, two or more outer aligning means 25 extending axially along the second end portion 27 of the blocking device. This movable engagement between each control means 51 on the release sleeve and each outer aligning means 25 on the blocking device 20 allows axial movement of the release sleeve relative to the second end portion 27 of the blocking device and is adapted to orient and entrain the release sleeve 50 and the blocking device together upon twisting of the release sleeve, possibly in concert with twisting of the operating sleeve 30, when the blocking device is in its blocking position.

The leak-free and repeatable manual dispensing of the correct amount of food 2 during its discharging occurs through the interworking of the operating sleeve 30, the blocking device 20, i.e., its first end portion 26, and the dispensing tank 10 (see FIG. 3, 4, 5, 8-11, 13A-D, 14A-C, 15A-C). The outer blocking means 12 on the dispensing tank are heel-like to produce a backstop function which allows twisting or rotation in the very same direction F' of both blocking device 20 and operating sleeve 30, which is translated into the axial discharging direction F of the piston 40 but it can at least partly or entirely block a twisting or rotation in the opposite direction R' of the blocking device but not of the operating sleeve. The opposite rotation direction R' of the operating sleeve 30 corresponds to the return direction R of the piston 40 (without the blocking device rotating back with the operating sleeve, the blocking device remains blocked in its position) but to a lesser, greater, or equal extent, i.e., the return position in the piston's return direction R, measured in axial distance, is less than, greater than, or the same as the piston's feeding stroke in the discharging direction F yet it relieves the pressure on the container 3 enough so that no food drips out from the outlet 5 in a way which is repeatable with a predetermined accuracy. The operating sleeve 30 comprises on its inside at least one engaging portion 31 which is complementary to and/or cooperates with the piston's outer engaging portions 41 in the form of one, two or more plane surfaces 31A, 31B pointing in the axial direction (see FIG. 7, 14A-14C). Each plane surface forms an abutment surface 31, 31A, 31B for piston engagement means 41 with its plane somewhat sloping yet primarily pointing by its plane surface perpendicular to the discharging F and return R direction and the longitudinal extension of the operating sleeve.

FIG. 14A-14C show cross sections of the feeding device 1 seen from the discharge end 15 looking in the direction of the first end 14 and FIG. 13A-13D show cross sections of the feeding device 1 seen from the opposite direction, i.e., from the first end 14 looking toward the discharge end 15.

The abutment surfaces 31A, 31B inside the operating sleeve 30 are arranged on each part or parts of a radially inward pointing and encircling inner flange or edge 37 for contact with outer piston wings 41. The inner edge 37 may have a constant or variable width in the longitudinal direction of the operating sleeve along two diametrically opposite arc sectors (see FIG. 14A, 14B), which do not need to be placed opposite each other. The arc sectors form two abutment surfaces 31A, 31B each in the form of an inclined plane along which each outer piston wing 41 can move along the inner peripheral extension of the operating sleeve when the operating sleeve 30 is twisted. Each inclined plane 31A, 31B therefore has a pitch S' in the operating sleeve's lengthwise direction/discharging direction F. The gradient S' provides an "extra" axial displacement of the piston 40 when the operating sleeve is twisted in the rotations/forward direction F' along the outer track 11 with its gradient S and entrains the blocking device 20 in its blocking position in the rotation direction F, since the operating sleeve 30 and its engaging portion 32 moves/slides by a lower section of the one inclined plane 31A with a lower "height"/lesser width and a lower stop 33B along a piston wing 41 to an upper section of this inclined plane 31A with a higher "height" and larger width and an upper stop 33A (see FIG. 7) in FIG. 13A (corresponding movement patterns hold for the other oppositely placed inclined plane 31B but relative to the other piston wing 41), wherein the total axial displacement of the piston 40 in the discharge direction F is the sum of the outer track's pitch S and the inclined plane's 31A, 31B gradient S', i.e., the total axial displacement in the discharging direction F of the piston 40 is =S+S', while the return position's axial displacement in the opposite direction R when the operating sleeve 30 is twisted back in the rotations/backward direction R' only corresponds to the inclined plane's gradient S' from the highest part back to the lowest part, since the blocking device is then "standing still" in the dispensing tank's outer track 11, i.e., it lies stationary against the dispensing tank's outer blocking means 12 by its internal movable blocking means 21 edge to edge, whereas the operating sleeve 30 can move.

The above maneuvering of the operating sleeve 30 occurs with a reciprocating movement. The operating sleeve is twisted forward in the rotation direction F' and backward in the rotation direction R' between one, two, three, four or more fixed stops 33A and 33B which enter into and out of abutment against one or more piston wings 41, which are "hard-set" turn stops for the operating sleeve (see FIG. 14A-C). Rotational entrainment of the blocking device 20 in its blocking position by means of the operating sleeve 30 is provided in that the operating sleeve comprises at a first end 34 at least one, two or more inner feeding abutments 32 (see FIG. 7, 13A-13D) for releasable engagement with at least one, two or more outer movable feeding means 22 of the blocking device 20 (see FIG. 5, 13A-D). Rotational locking of the blocking device is achieved in that the dispensing tank's external blocking means 12 goes into and out of engagement by steps with internal movable blocking means 21 of the blocking device 20 when it is entrained and twisted in the rotation/forward direction F' around in the dispensing tank's outer track 11 of the operating sleeve's feeding abutment 32 (see FIG. 13A-D). The operating sleeve's turn stops 33A, 33B are arranged at its other end 35. The inner stops 33A, 33B have a placement which is adapted to the placement of the operating sleeve's one, two or more inner feeding abutments 32 at its first end 34 and adapted for releasable engagement with the blocking device's two outer feeding means 22 at the blocking device's first end portion 26. The axial gradient S' of the operating sleeve's inner engaging portions 31, 31A, 31B looking in the longitudinal direction of the operating sleeve and the gradient S of the external track 11 are adapted to each other so that twisting of the operating sleeve 30 from its first inner stop 33A to its second inner stop 33B dispenses a defined quantity of food product 2 by means of a predetermined axial displacement of the piston 40 in the discharge direction F and a subsequent springback/twisting of the operating sleeve in the opposite direction R' from its second inner stop 33B to its first inner stop 33A allows an axial piston movement in the return direction R so that the container 3 is relieved of pressure and after-drip of food product is prevented in an exactly repeatable and controllable manner.

Figure 13B:
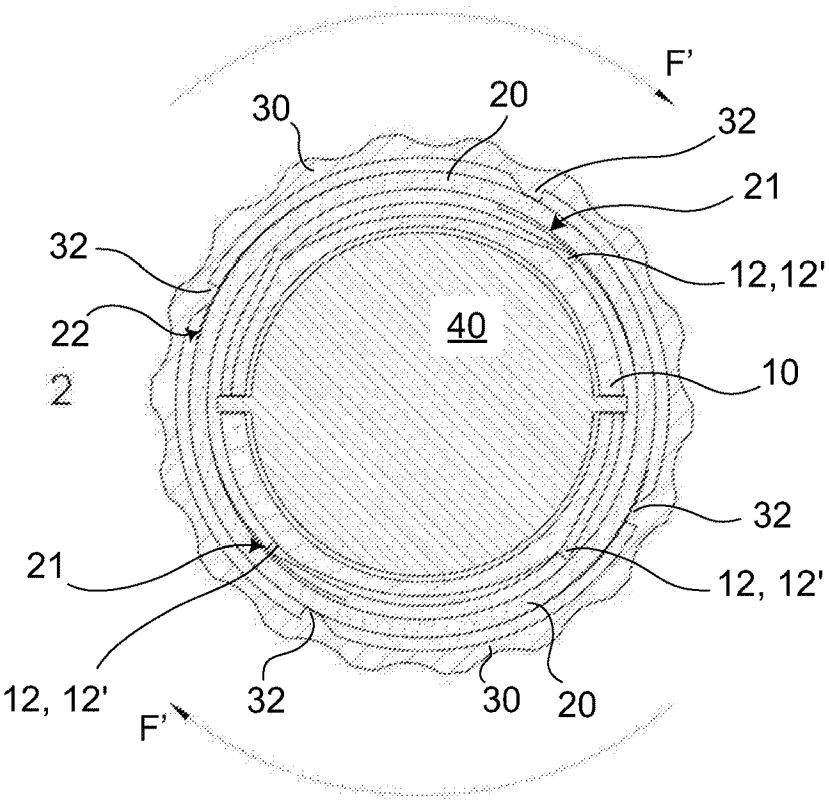
FIG. 13A to 13D show in various plan views the discharging device according to FIG. 1-4 as seen in its lengthwise direction and different functional positions for specific components during use.
Figure 15B:
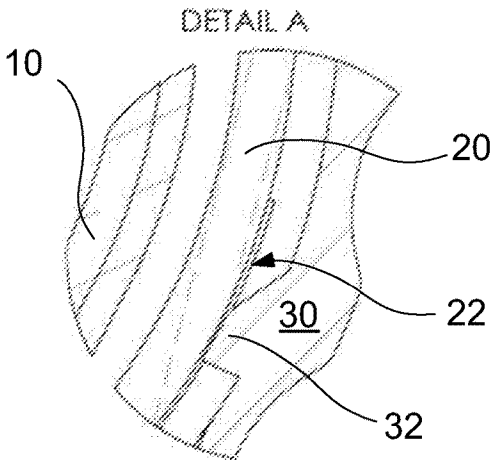
FIG. 15A to 15C show in a plan view and two partial enlargements the functional position of the discharging device according to FIG. 13B when specific components are in an intermediate position of interaction.
Figure 15C:
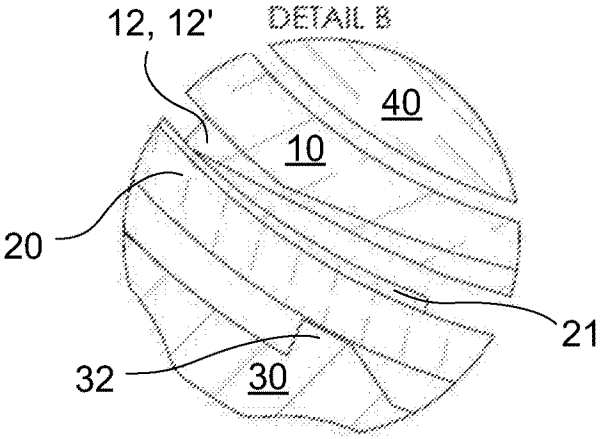
Figure 15A:
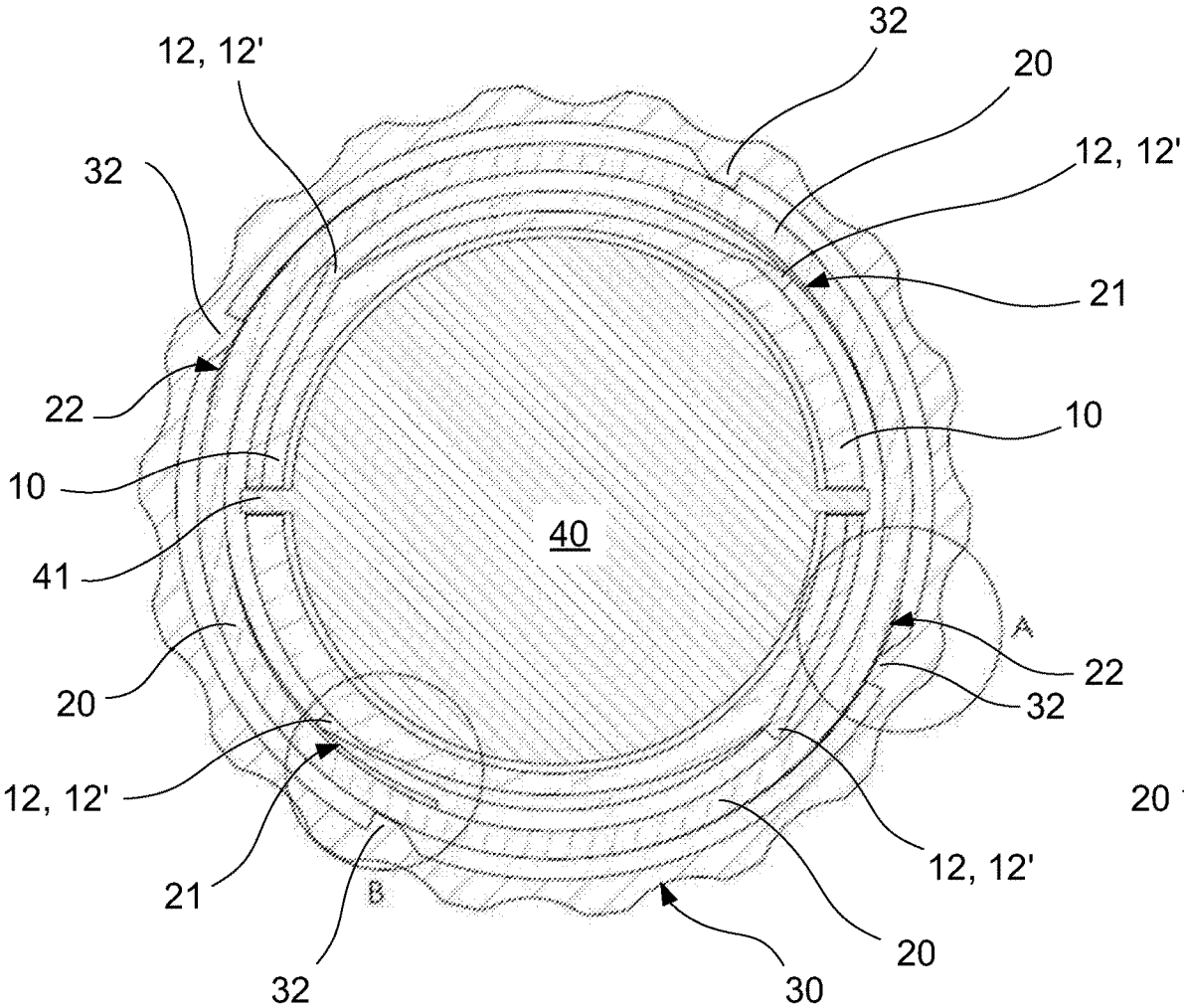

FIG. 15A-C show the assembly of the blocking device's outer movable feeding means 22 and inner movable blocking means 21 in greater detail corresponding to FIG. 13B which shows the intermediate positions before or after the blocking device's outer feeding means 22 and inner blocking means 21 have moved past the dispensing tank's outer heels 12 and the operating sleeve's feeding abutment 32.

The return stroke of the piston 40 in one embodiment is achieved in that the operating sleeve 30 comprises at least one biased moving part 36. This moving part 36 produces an automatic return movement or springback of the operating sleeve in the rotation return direction R' after the piston has been axially displaced for a predetermined distance in the discharging direction F and a defined quantity of food product 2 has been dispensed, whereby the piston is allowed/constrained to perform the corresponding return movement R which is equal in size to the "height difference" of the inclined plane 31, 31A, 31B, i.e., the gradient S' from its highest part to its lowest part. The return by means of this moving part 36 can be produced via a spring which is compressed when the operating sleeve 30 is twisted in the rotation direction F', and when the operating sleeve has reached its maximum forward position and slackens, i.e., the twisting of the operating sleeve is terminated, the compressed spring is released and its stored energy provides a force which forces the operating sleeve back in the opposite rotation direction R' corresponding to the length of the ascending plane 31, 31A, 31B and allows the piston 40 to perform its return stroke corresponding to the height or depth S' of the ascending plane as seen in the lengthwise direction of the feeding device 1.

Figure 13A:
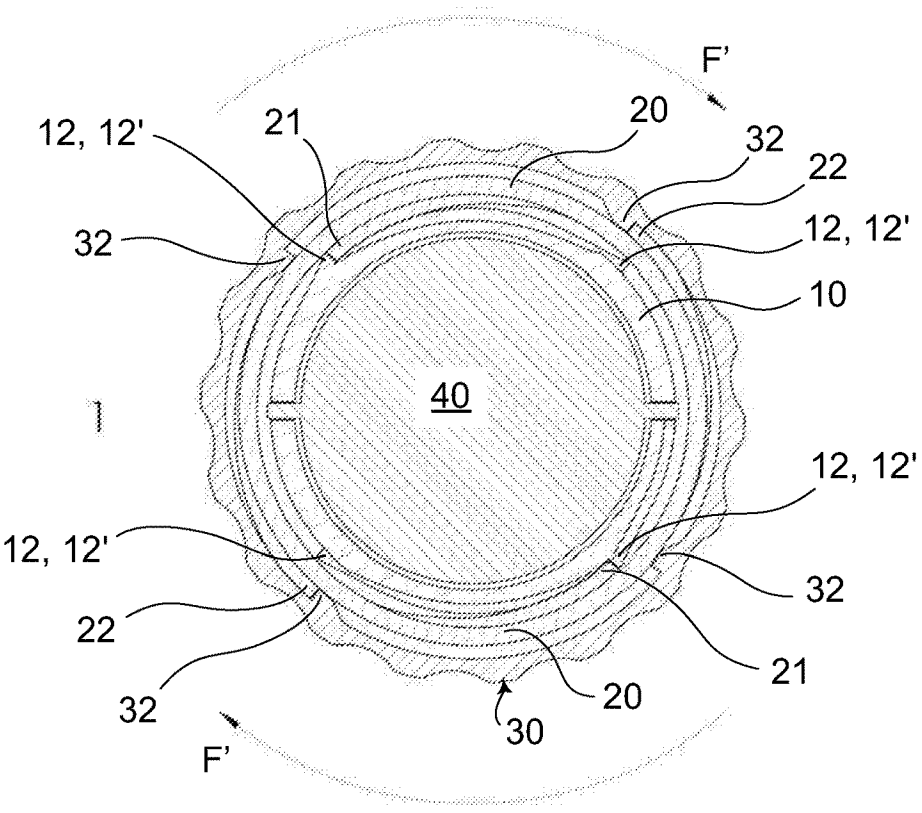
Figure 13D:
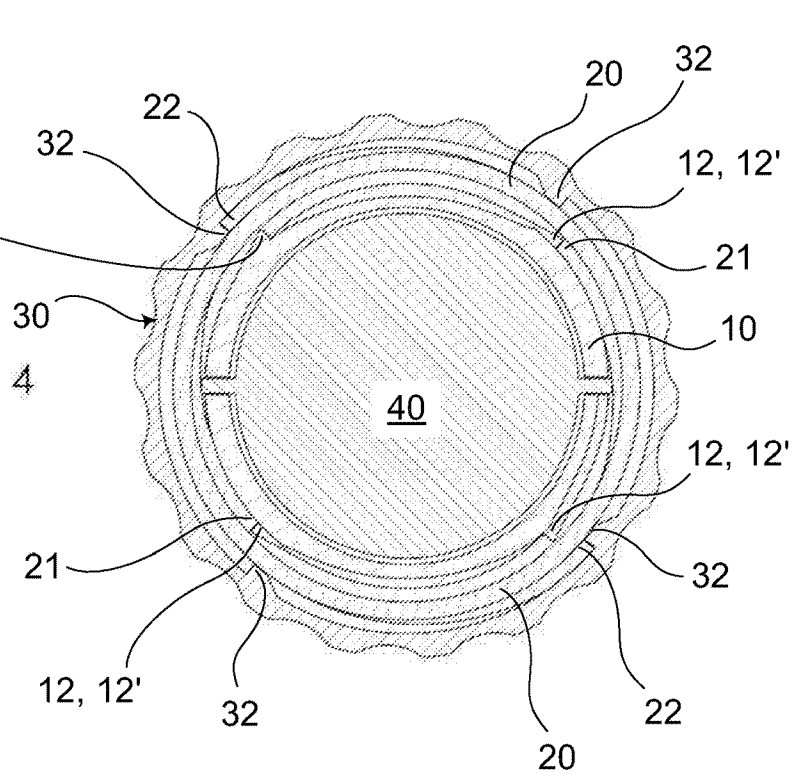
Figure 13C:
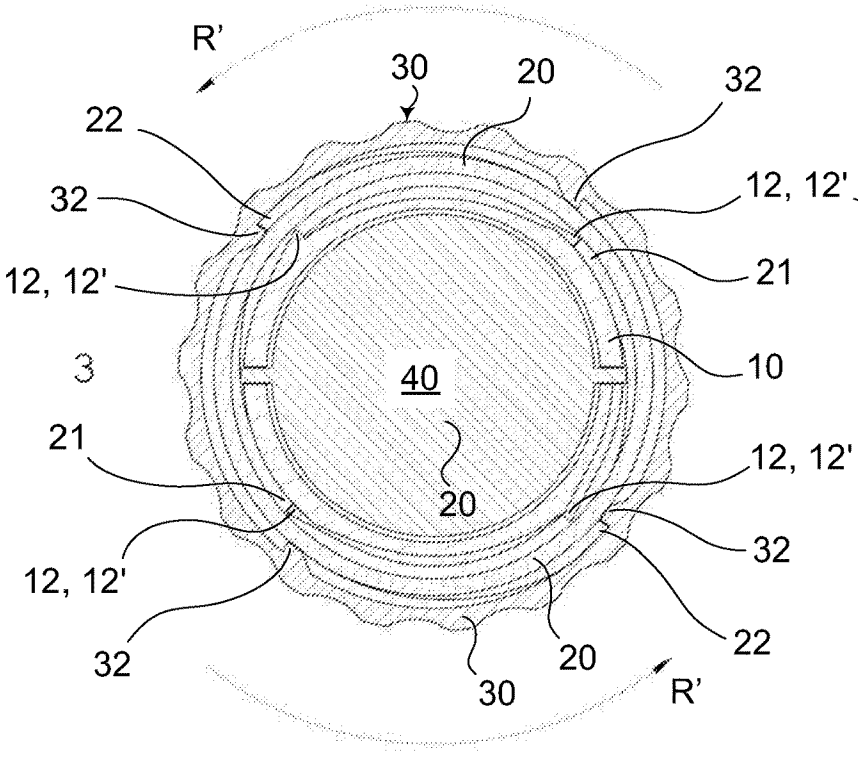

The feeding device 1 comprises a dispensing tank 10 with an outer continuous track 11 where a track slider 23 is in engagement, i.e., in contact/abutment when the blocking device 20 is in its active blocking position. Together with the external track 11 or alongside or basically parallel with this track there extends a cam or elevation or flank 12'. The elevation 12' and track 11 essentially follow each other sideways and basically parallel. The distance between them may be constant or variable. The height of the elevation 12' above the shell surface of the dispensing tank is not constant along the extension of the elevation and its height difference depends basically on the dispensing tank's outer blocking means 12 reaching over the elevation so as to be "grasped" by the blocking device's inwardly directed blocking means 21 acting as a feedback stop for the blocking device 20 when it is in its blocking position. This height difference also means that the depth of the track 11 varies at least partly along its extension, e.g., where the outer blocking means 12 is located. The dispensing tank's outer blocking means 12 is configured in a wedge or heel-shaped form, where the inclined plane of the wedge or heel and its gradient increase in the direction of the rotation F' as shown in FIG. 13A, 13B to the termination of the heel 12. This means that the heel's 12 termination faces the other opposite rotation direction R' (see FIG. 13C). The blocking device's blocking means 21 can move primarily along the dispensing tank's shell surface tangentially to and past each heel 12 and radially to the engagement behind the heel 12 when each blocking means 21 is past each heel as the blocking device is twisted in the rotation direction F' shown clockwise in FIG. 13A, 13B, but after this it cannot be moved back when the operating sleeve 30 is twisted in the opposite rotation direction R' shown counter clockwise in FIG. 13C and instead halts/remains against each resisting wall-like "back side" of each heel. The dispensing tank 10 has four pieces of outer blocking means or blocking heels 12 alongside and evenly distributed on the elevation 12'. The blocking means 12 are distributed evenly and/or unevenly over the periphery of the dispensing tank and the extension of the elevation 12'. The placement of the blocking means is adapted to the fixed turn stop 33A, 33B of the operating sleeve so that a twisting between them corresponds to a twisting between two of the outer heels 12 of the dispensing tank.

The operating sleeve 30 may contain fewer or more fixed turn stops, e.g., one, three, four or more turn stops 33A, 33B. The number of turn stops 33A, 33B and their layout along the inner periphery of the operating sleeve (evenly and/or unevenly distributed) depends on how large a rotary deflection is desired for the dispensing in the direction F, F' and the feedback in the direction R, R'. One turn stop 33A, 33B gives a deflection of around 360°, two turn stops give a deflection of around 180° and so forth, if evenly distributed. Here, the operating sleeve 30 has four turn stops 33A, 33B, which are placed in pairs. The placement of the blocking device's outwardly and inwardly directed blocking means 21 and 22 is adapted to the dispensing tank's outer blocking heels 12 and the operating sleeve's fixed turn stops 33A, 33B and its feeding abutment 32 and the arc length on its inner engaging portion with gradient S' (FIG. 3 shows each engaging portion 31, 31A, 31B with gradient S' as an arc segment/portion of the operating sleeve's inner circumference and FIG. 14A, 14B show the operating sleeve's partial deflection or arc segment corresponding to the engaging portion surface with gradient S' which moves in each rotary deflection, i.e., in pairs), so that each twisting in a rotation direction means a rotation of around 90°, i.e., a quarter of a full rotation turn. The rotation limitation may be less or greater in number of degrees depending on the quantity of food product 2 being dispensed, per the above. The pitch S at the dispensing tank's outer track 11 and the gradient S' of the operating sleeve's engaging portion may be adapted to the configuration of other parts and how many or how small the steps are desired for the feeding of the food 2. More and smaller steps mean more blocking means 12, turn stops 33A, 33B, feeding abutments 32, movable internal and/or inwardly directed feedback stops or blocking means/tabs 21 and movable external and/or outwardly directed feeding means or blocking means/tabs 22, while fewer and larger steps mean fewer such parts. The same holds accordingly for the gradients S and S', i.e., the smaller or finer the gradient, the shorter the axial displacement F, R or the smaller or slower the linear feeding per deflection and vice versa for a larger/coarser gradient.

In one aspect of the invention, the blocking device's 20 one or more outer feeding means 22 are movable and/or spring-loaded. In another aspect of the invention, the blocking device's internal blocking means 21 are movable and/or spring-loaded. The outlet 5 of the end cap 4 comprises a check valve 6 adapted to open in order to release food 2 forced out from the container 3 by the feeding device 1 and to close when the dispense flow ceases. The purpose of the check valve 6 of the outlet is to prevent air from getting in to the food in the dispensing system.

The food container 3 is initially fully closed. In order to ensure that it can be quickly coupled to the outlet 5 of the end cap in an air-tight manner and just as quickly be uncoupled in order to be replaced by a full container 3, a first air-tight quick coupling (not shown) is adapted to connect the container and the outlet 5 of the end cap to each other. The quick coupling may be of the previously known type, such as that according to document SE 1300164 A1, where the quick coupling has a first part, connected to the end cap outlet 5, having a tubular part with a first flow-through channel for food 2. The tubular part may have an edge adapted to push up a hole in the container in order to open it before the first part is pushed into the container and held fast there by friction between them. In this way, the container can be opened and coupled together with the end cap outlet 5 by means of the first quick coupling. When the container is empty it is simply disconnected by unscrewing the first part from the container together with the end cap 4 and outlet 5 or after the end cap has been removed separately, after which a full food container can be loaded into the feeding device 1 and hooked up in the above described way. Another emptying solution lacks the ability to make a hole in the container via a tubular part with edge penetrating the container, and instead an outlet built into the container is opened when a certain pressure has built up inside it so that the food product then flows out or is discharged through its outlet in the direction of and out through the outlet 5 of the end cap.

The studs or ribs or thread segment or tabs 22, 24 of the blocking device or feeding sleeve 20 can be made of metal or be movable by means of a built-in flexibility or the material of which they are made, such as silicone rubber or another similar elastic material, or they may be movable by virtue of their shape.

The track 11 and elevation 12' on the outside of the dispensing tank 10 has a partly discontinuous extension because the slot 13 along the dispensing tank extends through the track and the elevation, in other words, "cuts them off", and makes a hole through them and the shell surface of the dispensing tank.

The invention claimed is:

1. A feeding device for manual dispensing of a food product in fluid form packaged in a flexible container, comprising a dispensing tank adapted to hold the container, an operating sleeve arranged on top of the dispensing tank, and a piston arranged inside the dispensing tank and adapted to compress the container, which piston comprises at least one outer engagement means adapted to run through at least one slot in the dispensing tank for movable engagement with an inside of the operating sleeve, which operating sleeve comprises on the inside an engaging portion for cooperating with the piston's outer engagement means, so that the operating sleeve is adapted to axially displace the piston by rotation along the inside of the dispensing tank in a discharging direction (F) so that the container is compressed while dispensing food product and adapted to allow and/or alternatively to force a return of the piston in a return direction (R) opposite the discharging direction after each dispensing of food product, which feeding device comprises at least one blocking device adapted to allow axial movement of the piston in only the discharging direction (F) when the operating sleeve moves the piston in the discharging direction by releasable interacting engagement with the dispensing tank via at least one external spiral track on the dispensing tank, which outer track is adapted to engage with at least one inwardly facing track slider on the blocking device, which engagement after being coupled is adapted so that rotation of the blocking device only allows a rotation thereof in the outer track when the blocking device is in engagement with the outer track and in the blocking position in an active state, while a decoupling of the engagement allows axial displacement of the blocking device in relation to the dispensing tank when the blocking device is released with blocking device track slider from the blocking position in a passive state, and the operating sleeve at a first end comprises one or more inner feeding abutments adapted for releasable engagement with one or more outer feeding means of the blocking device.

2. The feeding device as claimed in claim 1, comprising at least one ring-shaped blocking device arranged in an annular space or gap between the inner dispensing tank and the outer operating sleeve.

3. The feeding device as claimed in claim 1, comprising at least one blocking device which is in the passive state when the blocking device is released from the blocking position and in the active state when the blocking device is located in the blocking position which allows axial movement of the piston in the discharging direction (F) when the operating sleeve is rotated in a first rotation direction (F') and allows axial piston movement (R) opposite the discharging direction when the operating sleeve is turned in a rotation direction (R') opposite the first rotation direction (F').

4. The feeding device as claimed in claim 1, wherein the dispensing tank comprises at least one or more continuous slots running axially along the lateral surface of the dispensing tank, through which slot(s) the piston's outer engagement means extends.

5. The feeding device as claimed in claim 1, wherein the piston comprises at least one or more externally placed engagement means.

6. The feeding device as claimed in claim 1, wherein at least one blocking device is in movable engagement with the operating sleeve and the dispensing tank such that the blocking device itself is limited to moving in only one rotation direction (F') translatable into axial movement in the discharging direction (F) of the piston when the blocking device is in the blocking position and active state.

7. The feeding device as claimed in claim 1, wherein the blocking device and the operating sleeve are adapted to each other so that a defined rotation of the operating sleeve in the first direction (F') means that it rotates together with the blocking device in the blocking position and active state such that a defined axial displacement is imposed on the piston so that the piston displaces a predetermined volume per step inside the dispensing tank in the discharging direction (F) and a following defined rotation of the operating sleeve opposite the first direction means that the operating sleeve only allows and/or alternatively constrains a defined return stroke of the piston in a direction (R) opposite the discharging direction for each dispensing of food product.

8. The feeding device as claimed in claim 7, wherein the dispensing tank, the blocking device and the operating sleeve are so adapted to each other that the return stroke (R) of the piston occurs with an equal, larger, or smaller volume displacement as compared to that in the discharging direction (F).

9. The feeding device as claimed in claim 1, wherein the dispensing tank's at least external spiral track has a definite gradient (S) for the movable and releasable interacting engagement with at least the inwardly directly track slider on the blocking device.

10. The feeding device as claimed in claim 1, wherein the operating sleeve's inner interacting engaging portion allows a rotation of both the operating sleeve and its interacting engaging portion in relation to the piston's engagement means under simultaneous axial displacement of the piston in both the return (R) and the discharging direction (F).

11. The feeding device as claimed in claim 1, wherein the operating sleeve's inner interacting engaging portion is a flange at least partly encircling inside the operating sleeve and directed inwardly, having a gradient (S') in the discharging direction (F).

12. The feeding device as claimed in claim 1, wherein the operating sleeve at a second end comprises one or more inner stops adapted for movable engagement with the piston's outer engagement means so that the rotational movement of the operating sleeve itself is limited in each of the rotation directions (F', R') when the inner stop on the operating sleeve comes into contact with corresponding outer engagement means on the piston.

13. The feeding device as claimed in claim 11, wherein the operating sleeve's inner interacting engaging portion comprises a planar surface configured as a sloping plane with gradient (S') arranged so that when the operating sleeve is rotated in one direction (F') the piston is displaced in the discharging direction (F) and when the operating sleeve is rotated in the opposite direction (R') the return stroke (R) of the piston is allowed and/or alternatively constrained.

14. The feeding device as claimed in claim 1, wherein the operating sleeve's inner stop is arranged at the other operating sleeve end for engagement with the piston's outer engagement means and the operating sleeve's inner stop has a placement which is adapted to the placement of the operating sleeve's inner feeding abutment at the first operating sleeve end, which feeding abutment is adapted for releasable engagement with the blocking device's outer feeding means at a first end portion, so that rotation (F') of the operating sleeve in a direction (F') from a first stop position to a second stop position moves the blocking device from a position of rest to a maximum position and brings about an axial displacement of the piston in the discharging direction (F) for compression of the container adapted to the quantity of food product being dispensed, and subsequent rotation of the operating sleeve in the opposite direction (R') from the second stop position of the operating sleeve in the maximum position back to the first operating sleeve stop position in the position of rest is allowed by releasing of the operating sleeve's engagement in the blocking device, which allows and/or alternatively constrains an axial displacement of the piston in the piston return direction (R).

15. The feeding device as claimed in claim 1, wherein the gradient (S') of the operating sleeve's inner engaging portions and the gradient (S) of the external track on the dispensing tank are adapted to each other so that rotation of the operating sleeve from t first operating sleeve stop position at the beginning of the gradient to t second operating sleeve stop position at the end of the gradient is adapted to dispense a defined quantity of food product by means of a predetermined axial displacement of the piston in the discharging direction (F), and subsequent rotation of the operating sleeve in the opposite direction from the second operating sleeve stop position back to the first operating sleeve stop position allows and/or alternatively constrains the axial piston displacement in the return direction (R).

16. The feeding device as claimed in claim 1, wherein the dispensing tank comprises external blocking means adapted to movable engagement with internal blocking means at one or more blocking devices, which engagement allows rotation of each blocking device in only one direction (F') translatable into the piston's axial discharging direction (F) by blocking the rotation of each blocking device in the opposite direction (R') corresponding to the piston's axial return direction (R).

17. The feeding device as claimed in claim 1, comprising one or more blocking devices comprising external blocking means adapted for releasable engagement with internal feeding abutments in the operating sleeve, which engagement allows a definite rotation of the operating sleeve in one direction (F') to entrain the blocking device in the same direction so that the piston is displaced axially in the discharging direction (F) for a predetermined distance adapted to the quantity of food product which is to be dispensed, and a defined rotation of the operating sleeve in the opposite direction (R') releases the operating sleeve from the entraining engagement with the blocking device, so that only the operating sleeve is rotated back while each blocking device remains in position, and allows and/or alternatively constrains an axial displacement of the piston in the return direction (R) for a predetermined distance relative to the piston displacement in the discharging direction.

18. The feeding device as claimed in claim 1, wherein the operating sleeve comprises at least one movable portion which is adapted to produce an automatic return movement of the operating sleeve in the return rotation direction (R') after the piston has been axially displaced along the dispensing tank for a predetermined distance in the discharging direction (F) and a defined quantity of food product has been dispensed, whereby the piston is allowed and/or alternatively constrained to perform a corresponding return movement (R) opposite the axial piston displacement in the discharging direction.

19. The feeding device as claimed in claim 1, comprising a release and return mechanism designed as a release sleeve adapted to manual coupling of the track slider engagement of at least one blocking device with the outer track of the dispensing tank for activating of the blocking position of the blocking device and manual releasing of the engagement with the outer track of the dispensing tank for deactivating of the blocking position of the blocking device by axial displacement along a second end section on the blocking device, by which the track slider of the blocking device is releasable from engagement with the outer track of the dispensing tank when the release sleeve is pushed off from the track slider and can be brought into engagement with the outer track of the dispensing tank when the release sleeve is pushed onto the track slider.

20. The feeding device as claimed in claim 19, wherein the release sleeve comprises at least one axially running control means adapted for movable engagement with at least one outer aligning means running axially along the second end section of the blocking device.

21. The feeding device as claimed in claim 19, wherein the release sleeve is adapted to activate the blocking position of the blocking device in engagement with the dispensing tank by axial displacement onto and along the second end section of the blocking device in the direction (F) toward a first end section on the blocking device into a first position corresponding to the blocking position of the blocking device when the track slider of the blocking device is in engagement with the outer track of the dispensing tank and adapted to deactivate the engagement of the blocking device's track slider with the outer track of the dispensing tank by axial displacement along the blocking device in the opposite direction (R) into a second position which releases the engagement of the blocking device's track slider and releases it from its blocking position on the dispensing tank.

22. The feeding device as claimed in claim 1, wherein the blocking device comprises movable outer parts on the second blocking device end section, which parts comprise the blocking device's track slider directed inward, and the release sleeve comprises inner axially extending control surfaces, which movable outer parts and inner control surfaces are adapted to each other such that the control surfaces inside the release sleeve press in the movable outer parts of the blocking device and the corresponding track slider when the release sleeve is shoved axially across the second end section of the blocking device in the direction (F) toward the first blocking device end section, into a first position in engagement with the dispensing tank where the blocking position of the blocking device is activated, and upon displacement of the release sleeve along the blocking device in the opposite direction (R) from the first blocking device end section the inner control surfaces move across and past the outer movable parts so that the blocking device track slider moves outward and thereby deactivates the blocking position of the blocking device by releasing engagement with the dispensing tank.

23. The feeding device as claimed in claim 22, wherein the inner axially extending control surfaces of the release sleeve are raised.

24. The feeding device as claimed in claim 1, wherein the dispensing tank comprises at least one external spiral track with a gradient (S) varying at least partly along its extension for movable releasable interacting engagement with at least one inwardly directed track slider on the blocking device, which engagement between the outer track and inner track slider and which gradient (S) after the coupling together are adapted such that rotation of the blocking device only allows rotation of the blocking device in the outer track when the blocking device is in the blocking position and a variable dispensing of food product, while a releasing from the engagement allows axial displacement of the blocking device in relation to the dispensing tank when the blocking device is released from its blocking position.

* * * * *